US008146780B2

(12) United States Patent
Compton et al.

(10) Patent No.: US 8,146,780 B2
(45) Date of Patent: Apr. 3, 2012

(54) INTERLOCKING DISPENSING SYSTEM FOR DISPENSING A PUMPABLE PRODUCTS

(75) Inventors: Stephen F. Compton, Spartanburg, SC (US); Daniel McKamy, Simpsonville, SC (US); Joseph M. Ramirez, Greenville, SC (US); Greg Harwood, Greenville, SC (US); William G. Kuecker, Dixon Springs, TN (US)

(73) Assignee: Cryovac, Inc., Duncan, SC (US)

( * ) Notice: Subject to any disclaimer, the term of this patent is extended or adjusted under 35 U.S.C. 154(b) by 391 days.

(21) Appl. No.: 12/316,751

(22) Filed: Dec. 16, 2008

(65) Prior Publication Data

US 2010/0147884 A1 Jun. 17, 2010

(51) Int. Cl.
*B65D 35/56* (2006.01)

(52) U.S. Cl. ..... 222/105; 222/81

(58) Field of Classification Search ..... 222/105, 222/100, 207, 81–83; 220/277, 278; 383/200–202; 229/117.27, 117.28, 117.3, 117.31, 117.35
See application file for complete search history.

(56) References Cited

U.S. PATENT DOCUMENTS

| | | | | |
|---|---|---|---|---|
| 4,247,020 | A | 1/1981 | Desjardins | |
| 4,314,654 | A | 2/1982 | Gaubert | |
| 4,416,395 | A | 11/1983 | Gaubert | |
| 4,521,437 | A | 6/1985 | Storms | |
| 4,562,940 | A * | 1/1986 | Asphar | 222/88 |
| 4,589,247 | A | 5/1986 | Tsuruta et al. | |
| 4,603,793 | A | 8/1986 | Stern | |
| 4,656,818 | A | 4/1987 | Shimoyama et al. | |
| 4,746,562 | A | 5/1988 | Fant | |
| 4,768,411 | A | 9/1988 | Su | |
| 4,808,010 | A | 2/1989 | Vogan | |
| 4,907,722 | A * | 3/1990 | Ueda et al. | 222/83 |
| 4,946,040 | A * | 8/1990 | Ipenburg | 383/202 |
| 5,125,541 | A | 6/1992 | Anglehart | |
| 5,421,485 | A * | 6/1995 | Furuta et al. | 222/95 |
| 5,467,581 | A | 11/1995 | Everette | |
| 5,755,359 | A * | 5/1998 | Joensson | 222/83 |
| 6,398,073 | B1 | 6/2002 | Nicolle | |
| 6,554,164 | B1 * | 4/2003 | Jones | 222/105 |
| 6,988,639 | B2 | 1/2006 | Arch | |
| 7,011,233 | B2 | 3/2006 | Drennow | |
| 7,165,700 | B2 | 1/2007 | Macler et al. | |
| 7,188,749 | B2 * | 3/2007 | Miller et al. | 222/1 |
| 7,886,778 | B2 * | 2/2011 | McDowell | 141/10 |
| 2004/0139697 | A1 * | 7/2004 | Reddy et al. | 53/412 |
| 2006/0111224 | A1 | 5/2006 | Caudle | |
| 2006/0283879 | A1 | 12/2006 | Rasmussen | |
| 2008/0083788 | A1 | 4/2008 | Py et al. | |
| 2008/0087713 | A1 | 4/2008 | Deniston et al. | |
| 2008/0116226 | A1 | 5/2008 | Py et al. | |
| 2008/0121766 | A1 | 5/2008 | Jorgensen | |
| 2009/0283541 | A1 * | 11/2009 | Compton et al. | 222/105 |
| 2010/0038380 | A1 * | 2/2010 | Compton | 222/105 |

FOREIGN PATENT DOCUMENTS

| | | |
|---|---|---|
| FR | 2672279 | 8/1992 |
| WO | 2005/040034 A2 | 5/2005 |

* cited by examiner

*Primary Examiner* — Lien T Ngo
(74) *Attorney, Agent, or Firm* — Ashley D. Wilson

(57) ABSTRACT

The presently disclosed subject matter comprises a pouch to house a pumpable product, a pouch fitment to the pouch, and an enclosing carton for containing the pouch and fitment. The system further comprises a pump assembly that pierces the pouch fitment and interacts with the carton to dispense the pouch contents.

12 Claims, 19 Drawing Sheets

INTERLOCKING DISPENSING SYSTEM FOR DISPENSING A PUMPABLE PRODUCTS

TECHNICAL FIELD

The presently disclosed subject matter relates generally to a system and method for dispensing a pumpable product, the system and method comprising an enclosing carton, a pouch disposed therein, and a pump assembly.

BACKGROUND

Vertical form/fill/seal ("VFFS") packaging systems have proven to be useful in packaging a wide variety of food and non-food pumpable products. One example of such a system is the Onpack™ packaging system marketed by Cryovac/Sealed Air Corporation (Saddle Brook, N.J., United States of America). The VFFS process is known to those of ordinary skill in the art, and is described in U.S. Pat. No. 4,589,247 to Tsuruta et al.; U.S. Pat. No. 4,656,818 to Shimoyama et al.; U.S. Pat. No. 4,768,411 to Su; and U.S. Pat. No. 4,808,010 to Vogan, inter alia, all incorporated herein in their entireties by reference thereto.

In such a process, lay-flat thermoplastic film is first advanced over a forming device to form a tube. Next, a longitudinal (vertical) fin or lap seal is made, and a bottom end seal is formed by transversely sealing across the tube with heated seal bars. A pumpable product is introduced through a central, vertical fill tube to the formed tubular film. The pouch is then completed by sealing the upper end of the tubular segment, and severing the pouch from the tubular film above it. The process can be a two-stage process wherein the creation of a transverse heat seal occurs at one stage of the process, and downstream of the first stage, a separate pair of cooling/clamping means contact the newly-formed transverse heat seal to cool and thus strengthen the seal. In some VFFS processes, an upper transverse seal of a first pouch and the lower transverse seal of a following pouch are made. The pouches are then cut and thereby separated between two portions of the transverse seals without the need for a separate step to clamp, cool, clamp, cool, and cut the seals. A commercial example of an apparatus embodying the more simplified process is the Onpack™ 2050A VFFS packaging machine marketed by Cryovac/Sealed Air Corporation.

U.S. Pat. No. 4,603,793 to Stern, incorporated herein in its entirety by reference thereto, discloses fitment mounted on the inside wall of a pouch. The fitment offers several advantages in packaging products, such as the capability of connecting the fitment to a pumping device. The fitment further permits the contents of the package to be dispensed in a controllable manner. Packaging systems combining the Onpack™ system with the fitment technology of Stern have proven effective in providing a pouch-making system wherein a pouch containing a product includes an internal fitment. The fitment is typically near one end of the pouch to ensure that the contents of the pouch are directed, e.g., by gravity, toward and pumped from and through the fitment by a suitable pump dispensing system. One example of a method and apparatus for installing fitments of the type disclosed by Stern is disclosed in U.S. Pat. No. 5,467,581 to Everette, incorporated herein in its entirety by reference thereto. An alternative system is disclosed in U.S. Patent Publication No. 2006/0111224A1 to Caudle, incorporated herein in its entirety by reference thereto.

In many industries, including quick service restaurants and the like, pumpable products are typically dispensed from relatively small stainless steel or plastic product wells. Such wells are typically manually filled by store employees, and are usually in one of two arrangements. In the first arrangement, the well is manually filled with a pumpable product, such as flavored toppings, sauces, liquid condiments of various viscosities (ketchup, mustard, mayonnaise, etc.), and the like. The employee spoons out a more or less appropriate amount of the product as needed. The arrangement can sometimes be accessed directly by the customer.

An alternative arrangement includes a cover, typically made of stainless steel, having a portion control pump fitted therein. After manual filling of a well, a cover carrying or accommodating a pump is dropped onto the top of the well. The pump is conventional in nature for this application, and those skilled in the art will be familiar with the various makes and models of pumps and their operation, such that further details are not provided herein. After filling the product well and installing the cover and pump, the pump can be activated as needed, e.g., manually, to dispense a controlled portion of the product from the well, through the pump, and onto a plate, food product, container, etc.

However, the current systems for dispensing pumpable products suffer from several problems. First, product wells tend to be small in volume, typically about 0.5 gallons, such that they require frequent refilling in high-use environments. Second, refilling is accomplished by pouring the product from rigid or semi-rigid containers, such as cans or jugs. When an employee, particularly an inexperienced one, attempts a refill, the process can be untidy, as product misses the well, overflows past the top of the well, etc.

A third problem associated with conventional systems is the need to periodically clean the well. When very viscous and/or high sugar content products are being used, properly cleaning the well can be labor-intensive, time-consuming, and difficult. In addition, product freshness becomes an issue when the product is disposed in the well for an extended period of time. Product freshness issues can be aggravated by conditions where the product is dispensed at relatively high temperatures, wherein evaporation through long exposure to high temperatures significantly and adversely affects the quality of the product.

In addition, current dispensing systems have potential food safety challenges. Particularly, because current systems are generally open in nature (i.e., the cover is removed to refill the dispensed product), there is the potential for contamination resulting from the ambient environment and/or tampering. The frequent opening of current dispensing systems (i.e., when refilling the product wells) exposes the dispensed product to the outside environment. As a result, bacteria and/or other microbial contaminants can contaminate the dispensed product. In addition, because the cover can be easily removed, there is no indication to consumers or employees whether tampering of the dispensed product has occurred. Accordingly, current dispensing systems can be hazardous, exposing the dispensed product to contamination from the environment and/or from potential tampering.

Further, one disadvantage associated with the use of conventional systems stems from their orientation in use. Typically, because of the presence of a pump dip tube, a free end of which lies near the bottom of the container, the dispenser must be used in an upright fashion where the head is positioned above the product and the product extends in a direction pointing substantially straight down to the ground. This condition is dictated by the fact that the free end of the dip tube should always be immersed in the product to be dispensed in order to maintain proper function. In addition, because of the elasticity of the pouch, the risk is high for the pouch to obstruct the orifice of the dip tube. The risk is also high, depending on the thickness of the walls of the pouch, for the end of the dip tube to pierce the walls of the pouch.

SUMMARY

In some embodiments, the presently disclosed subject matter is directed to a dispensing system for dispensing a pumpable product comprising an enclosing carton, a pouch disposed within the carton, and a pump assembly. The enclosing carton comprises a top face, a bottom face, first and second side faces, a front face, and a rear face. The enclosing carton also comprises a first cut out located on the bottom face to accommodate a pouch fitment and a second cut out located on the rear face and the first and second a side faces, the second cut out comprising a horizontal and vertical portion. The enclosing carton further comprises a third cut out located on the front face. The pouch comprises the pumpable product and comprises a first wall and a second wall, a first end and a second end, a first side edge and a second side edge, a first transverse seal and a second transverse seal, and a longitudinal seal disposed between the first side edge and the second side edge, and extending from the first transverse seal to the second transverse seal. A pouch fitment is disposed on the outer surface of the first wall of the pouch, wherein the pouch fitment is disposed within the first cut out on the bottom face of the carton. The pump assembly comprises a top side and a bottom side, the top side comprising a piercing fitment that aligns with the pouch fitment. The pump assembly also comprises two connecting arms positioned upward from the top side, wherein the connecting arms are joined together by a connector that is inserted into the second cut out. The pump assembly further comprises a support arm comprising a support means that fits into the third cut out. The pump assembly also comprises a dispensing mechanism.

In some embodiments, the presently disclosed subject matter is directed to a method of dispensing a pumpable product, said method comprising providing a carton comprising a top face, a bottom face, first and second side faces, a front face, and a rear face. The carton also comprises a first cut out located on the bottom face to accommodate a pouch fitment and a second cut out located on the rear face and the first and second side faces, said second cut out comprising a horizontal and a vertical portion. The method also comprises providing a pouch comprising a first wall and a second wall, a first end and a second end, a first side edge and a second side edge, a first transverse seal and a second transverse seal, and a longitudinal seal disposed between the first side edge and the second side edge, and extending from the first transverse seal to the second transverse seal. The pouch also comprises a pouch fitment disposed on the outer surface of the first wall of the pouch, wherein the pouch fitment is disposed within the first cut out on the bottom face of the carton. The method also comprises providing a pump assembly comprising a top side and a bottom side, wherein the top side comprises a piercing fitment that aligns with the pouch fitment. The pump assembly also comprises first and second connecting arms positioned upward from the top side, wherein the connecting arms are connected together by a connector that is inserted into the second cut out. The pump assembly further comprises a third arm comprising a support means that fits into the third cut out, and a dispensing mechanism. The method comprises filling the pouch with a pumpable product and positioning the pouch inside the carton such that the pouch fitment is supported by the first cut out. The connector of the pump assembly is then positioned into the horizontal portion of the second cut out. The connector of the pump assembly is then positioned into the vertical portion of the second cutout. The pump assembly is next positioned adjacent to the bottom face of the carton such that the pouch fitment is aligned with the piercing fitment. The pouch is then pierced with the piercing fitment by positioning said piercing fitment within the pouch fitment. The supporting means of the supporting arm is then inserted into the third cut out of the carton, and the pump assembly is initiated to dispense pumpable product out of the pouch.

In some embodiments, the presently disclosed subject matter is directed to a method of dispensing a pumpable product, said method comprising providing a carton comprising a top face, a bottom face, first and second side faces, a front face, and a rear face. The carton also comprises a first cut out located on the bottom face to accommodate a pouch fitment and a second cut out located on the rear face and the first and second side faces, said second cut out comprising a horizontal and a vertical portion. The method also comprises providing a pouch comprising a first wall and a second wall, a first end and a second end, a first side edge and a second side edge, a first transverse seal and a second transverse seal, and a longitudinal seal disposed between the first side edge and the second side edge, and extending from the first transverse seal to the second transverse seal. The pouch also comprises a pouch fitment disposed on the outer surface of the first wall of the pouch, wherein the pouch fitment is disposed within the first cut out on the bottom face of the carton. The method also comprises providing a pump assembly comprising a top side and a bottom side, wherein the top side comprises a piercing fitment that aligns with the pouch fitment. The pump assembly also comprises first and second connecting arms positioned upward from the top side, wherein the connecting arms are connected together by a connector that is inserted into the second cut out. The pump assembly further comprises a third arm comprising a support means that fits into the third cut out, and a dispensing mechanism. The method comprises filling the pouch with a pumpable product and positioning the pouch inside the carton such that the pouch fitment is supported by the first cut out. The connector of the pump assembly is then positioned into the horizontal portion of the second cut out. The pump assembly is next positioned adjacent to the bottom face of the carton such that the pouch fitment is aligned with the piercing fitment. The connector of the pump assembly is then positioned into the vertical portion of the second cutout. The pouch is then pierced with the piercing fitment by positioning said piercing fitment within the pouch fitment. The supporting means of the supporting arm is then inserted into the third cut out of the carton, and the pump assembly is initiated to dispense pumpable product out of the pouch.

In some embodiments, the presently disclosed subject matter is directed to a method of making a dispensing system, said method comprising providing a carton comprising a top face, a bottom face, first and second side faces, a front face, and a rear face. The carton also comprises a first cut out located on the bottom face to accommodate a pouch fitment, and a second cut out located on the rear face and the first and second side faces, the second cut out comprising a horizontal and a vertical portion. The carton further comprises a third cutout located on the front face. The method also comprises providing a pouch comprising a first wall and a second wall, a first end and a second end, a first side edge and a second side edge, a first transverse seal and a second transverse seal, and a longitudinal seal disposed between the first side edge and the second side edge, and extending from the first transverse seal to the second transverse seal. The pouch also comprises a pouch fitment disposed on the outer surface of the first wall of the pouch, wherein the pouch fitment is disposed within the first cut out on the bottom face of the carton. The method further comprises providing a pump assembly comprising a top side and a bottom side, wherein the top side comprises a piercing fitment that aligns with the pouch fitment. The pump assembly further comprises two connecting arms positioned upward from the top side, wherein the connecting arms are connected together by a connector that is inserted into the second cut out. The pump assembly further comprises a support arm comprising a support means that fits into the third cut out, and a dispensing mechanism. The method further comprises filling the pouch with a pumpable product and positioning the pouch inside the carton such that the pouch fitment is supported by the first cut out. The connector of the pump assembly is then positioned into the horizontal portion of the second cut out. The connector of the pump assembly is then positioned into the vertical portion of the second cut out. The pump assembly is then positioned adjacent to the bottom face of the carton such that the pouch fitment is aligned with the piercing fitment. The pouch is next pierced with the piercing fitment by positioning the piercing fitment within the pouch fitment. The supporting means of the supporting arm is then inserted into the third cut out of the carton, and the pump assembly initiated to dispense pumpable product from the pouch.

In some embodiments, the presently disclosed subject matter is directed to a method of making a dispensing system, said method comprising providing a carton comprising a top face, a bottom face, first and second side faces, a front face, and a rear face. The carton also comprises a first cut out located on the bottom face to accommodate a pouch fitment, and a second cut out located on the rear face and the first and second side faces, the second cut out comprising a horizontal and a vertical portion. The carton further comprises a third cutout located on the front face. The method also comprises providing a pouch comprising a first wall and a second wall, a first end and a second end, a first side edge and a second side edge, a first transverse seal and a second transverse seal, and a longitudinal seal disposed between the first side edge and the second side edge, and extending from the first transverse seal to the second transverse seal. The pouch also comprises a pouch fitment disposed on the outer surface of the first wall of the pouch, wherein the pouch fitment is disposed within the first cut out on the bottom face of the carton. The method further comprises providing a pump assembly comprising a top side and a bottom side, wherein the top side comprises a piercing fitment that aligns with the pouch fitment. The pump assembly further comprises two connecting arms positioned upward from the top side, wherein the connecting arms are connected together by a connector that is inserted into the second cut out. The pump assembly further comprises a support arm comprising a support means that fits into the third cut out, and a dispensing mechanism. The method further comprises filling the pouch with a pumpable product and positioning the pouch inside the carton such that the pouch fitment is supported by the first cut out. The connector of the pump assembly is then positioned into the horizontal portion of the second cut out. The pump assembly is then positioned adjacent to the bottom face of the carton such that the pouch fitment is aligned with the piercing fitment. The connector of the pump assembly is then positioned into the vertical portion of the second cut out. The pouch is next pierced with the piercing fitment by positioning the piercing fitment within the pouch fitment. The supporting means of the supporting arm is then inserted into the third cut out of the carton, and the pump assembly initiated to dispense pumpable product from the pouch.

DETAILED DESCRIPTION

I. General Considerations

The presently disclosed subject matter will now be described more fully hereinafter with reference to the accompanying drawings, in which some but not all embodiments are shown. Indeed, the presently disclosed subject matter can be embodied in many different forms and should not be construed as limited to the embodiments set forth herein. Like numbers refer to like elements throughout.

Figure 1:
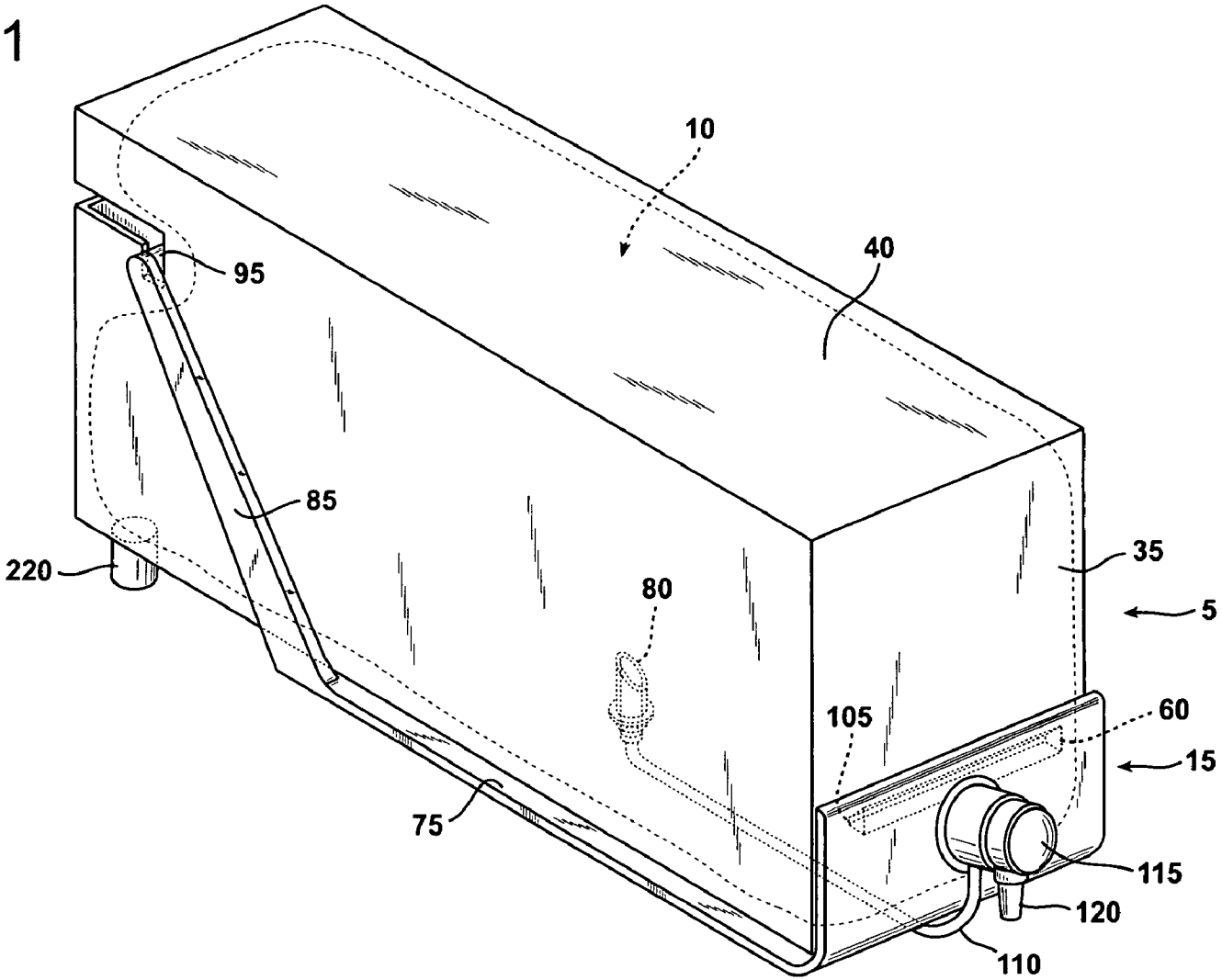
FIG. 1 is a perspective view of a dispensing system of the presently disclosed subject matter.
Figure 2A:
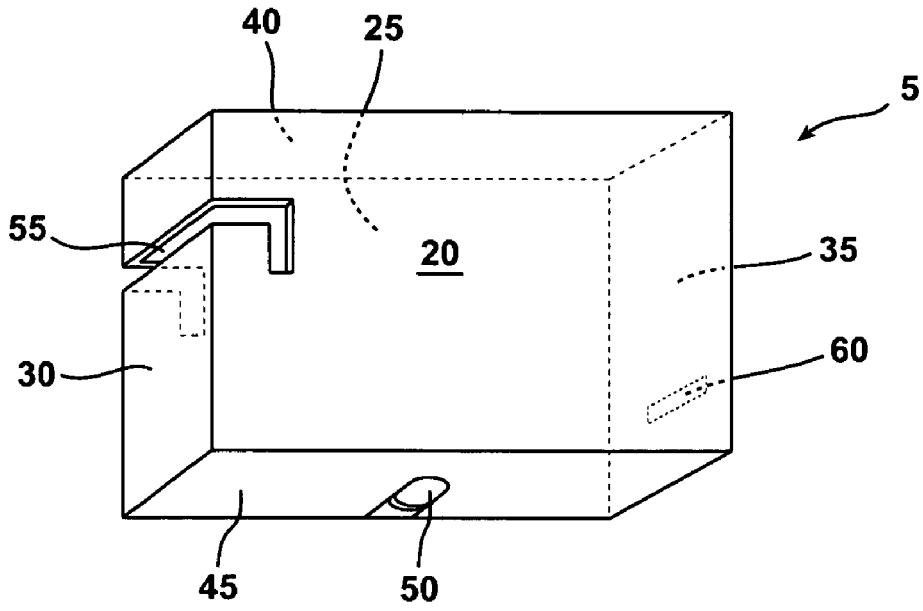
FIG. 2*a* is a perspective view of a carton of the disclosed dispensing system.
Figure 2B:
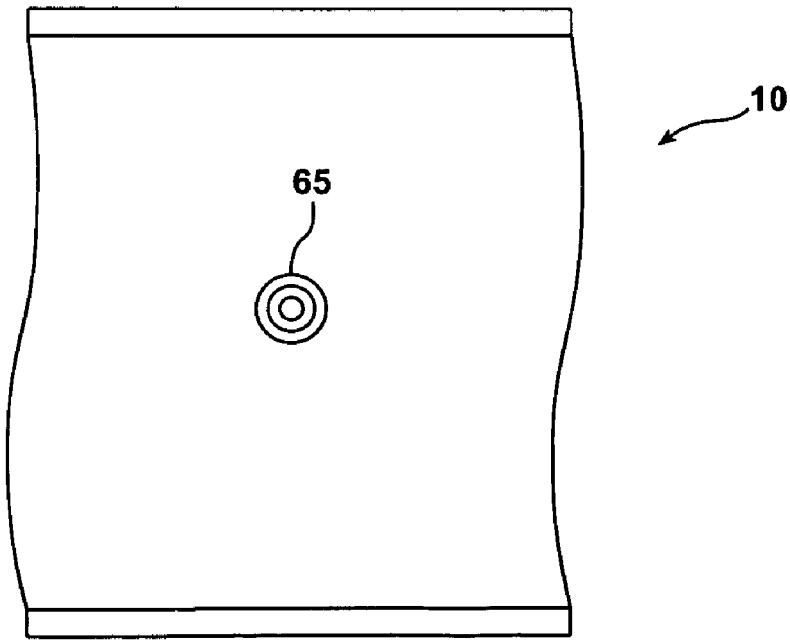
FIG. 2*b* is a top plan view of a pouch of the disclosed dispensing system.
Figure 2C:
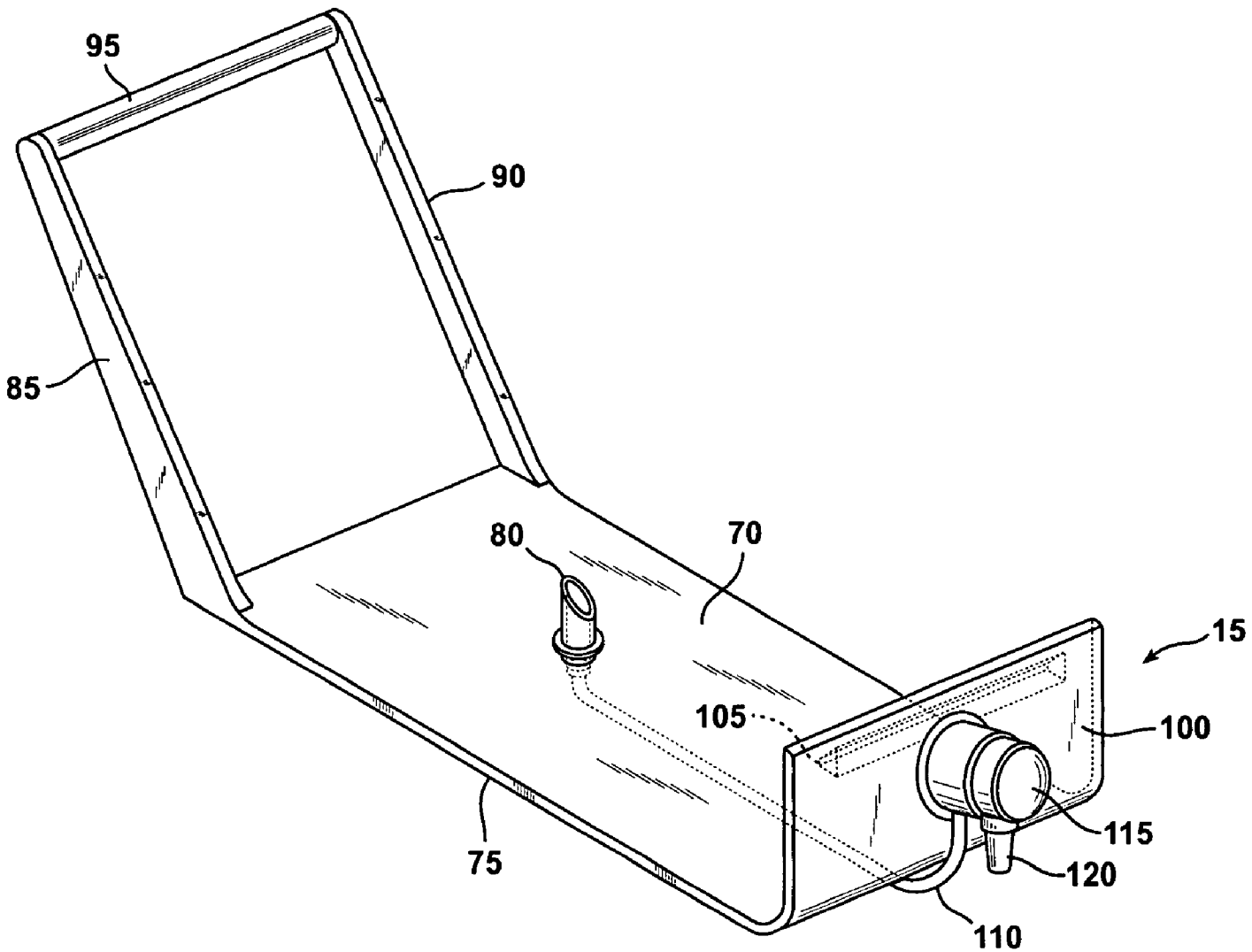
FIG. 2*c* is a perspective view of a pump assembly of the disclosed dispensing system.

FIG. 1 illustrates a general dispensing system of the presently disclosed subject matter. Particularly, the disclosed system comprises carton 5, pouch 10, and pump assembly 15. As illustrated, pouch 10 is enclosed within carton 5 and pump assembly 15 interlocks with the carton. FIGS. 2*a*, 2*b*, and 2*c* illustrate the components of the dispensing system in more detail.

Figure 13A:
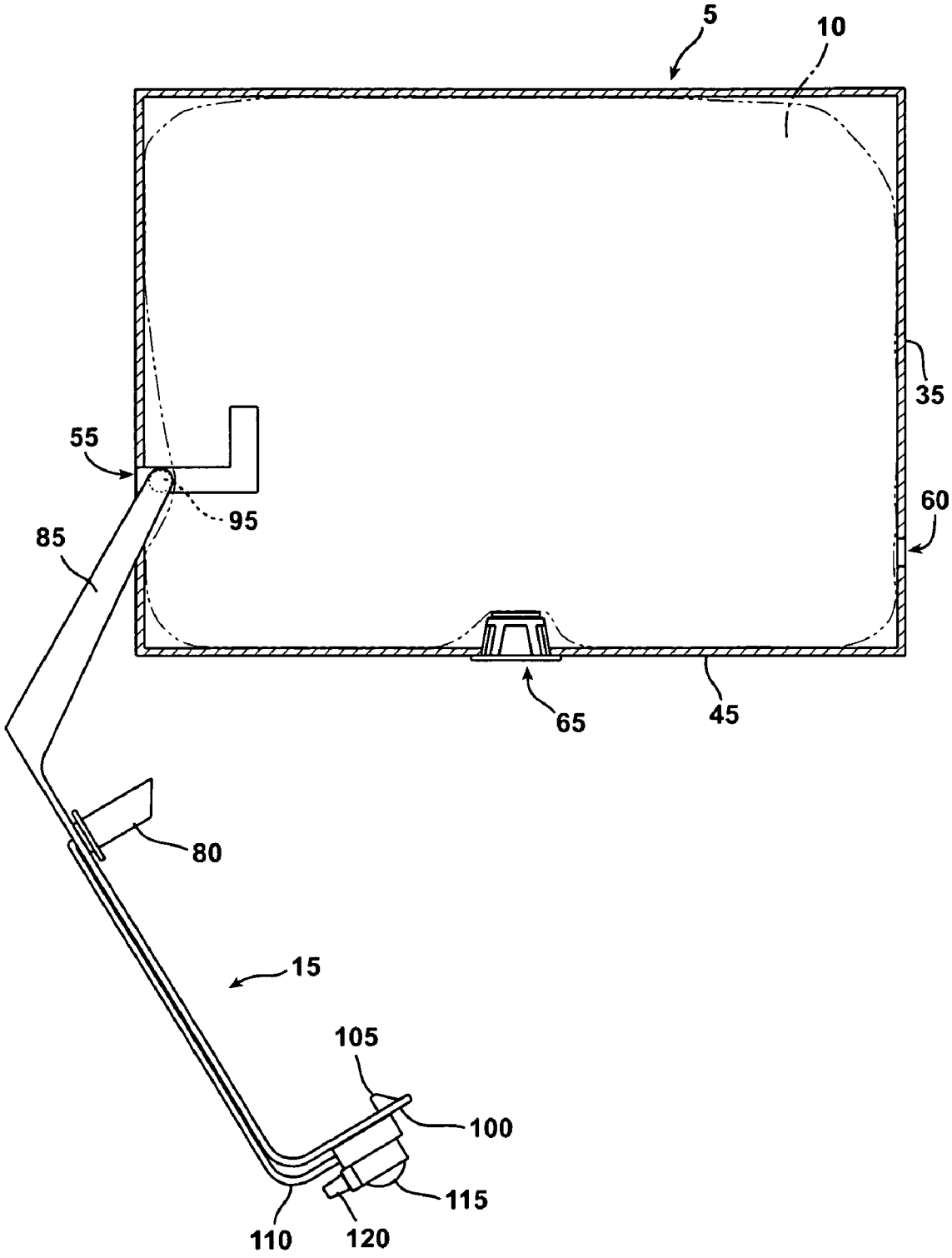
FIGS. 13*a* through 13*d* are side elevation views of the disclosed dispensing system.

FIG. 2*a* illustrates that carton 5 comprises side faces 20 and 25, front face 35, rear face 30, top face 40, and bottom face 45. As set forth in more detail herein below, bottom face 45 comprises first cut out 50 that houses external pouch fitment 65 disposed on one wall of pouch 10. In addition, carton 5 comprises second cut out 55, which has horizontal and vertical portions, and third cut out 60, both of which interlock with pump assembly 15. As used herein, the terms "first", "second", and "third" are not intended to be limiting, and are merely included as a means to identify the cut outs. As illustrated in FIG. 2*a*, in some embodiments, second cut out 55 is oriented with the vertical portion turned downward (i.e., toward bottom face 45). However, in some embodiments, second cut out 55 is oriented with the vertical portion turned upward (i.e., toward top face 40), as illustrated in FIG. 13*a*.

FIG. 2*b* illustrates pouch 10 of dispensing system 1. Pouch 10 comprises external pouch fitment 65 disposed on one face of the pouch. Pouch 10 is folded within carton 5 such that pouch fitment 65 fits securely into first cut out 50, as set forth in more detail herein below.

As depicted in FIG. 2*c*, pump assembly 15 comprises top side 70 and bottom side 75. Piercing fitment 80 is located on top side 70 of the pump assembly base. Tubing 110 connects piercing fitment 80 to dispensing mechanism 115 comprising exit port 120. In addition, one end of pump assembly 15 comprises connecting arms 85, 90 that extend up and away from top side 70 and are joined together at connector 95. The other end of pump assembly 15 comprises support arm 100 that extends up and away from top side 70 and follows the approximate line of front face 35. Support arm 100 comprises support means 105 that extends approximately parallel to top side 70 of pump assembly 15. Connector 95 and support member 105 function to adaptably interlock with carton 5, as set forth in more detail herein below.

Thus, the dispensing system provides methods of storing and dispensing a pumpable product. Particularly, the ease of use of pump assembly 15 allows inexperienced users to successfully pierce pouch 10 to dispense the contents of the pouch. Once the contents of pouch 10 have been dispensed, the end user can detach and dispose of pouch 10 and/or carton 5, leaving pump assembly 15 ready for use on the next system. Alternatively, in some embodiments, the user can discard pouch 10, pump assembly 15, and carton 5 and purchase a new dispensing system.

II. Definitions

While the following terms are believed to be understood by one of ordinary skill in the art, the following definitions are set forth to facilitate explanation of the presently disclosed subject matter.

Unless defined otherwise, all technical and scientific terms used herein have the same meaning as commonly understood to one of ordinary skill in the art to which the presently disclosed subject matter pertains. Although any methods, devices, and materials similar or equivalent to those described herein can be used in the practice or testing of the presently disclosed subject matter, representative methods, device, and materials are now described.

Following long-standing patent law convention, the terms "a", "an", and "the" can refer to "one or more" when used in the subject specification, including the claims. Thus, for example, reference to "a pouch" (e.g., "a dispensing pouch") includes a plurality of such pouches, and so forth.

Unless otherwise indicated, all numbers expressing quantities of components, conditions, and so forth used in the specification and claims are to be understood as being modified in all instances by the term "about". Accordingly, unless indicated to the contrary, the numerical parameters set forth in the instant specification and attached claims are approximations that can vary depending upon the desired properties sought to be obtained by the presently disclosed subject matter.

As used herein, the term "about", when referring to a value or to an amount of mass, weight, time, volume, concentration, or percentage can encompass variations of, in some embodiments ±20%, in some embodiments ±10%, in some embodiments ±5%, in some embodiments ±1%, in some embodiments ±0.5%, and in some embodiments to ±0.1%, from the specified amount, as such variations are appropriate in the disclosed system and methods.

As used herein, the term "abuse layer" refers to an outer film layer and/or an inner film layer, so long as the film layer serves to resist abrasion, puncture, and other potential causes of reduction of package integrity, as well as potential causes of reduction of package appearance quality. The abuse layer can comprise any polymer, so long as the polymer contributes to achieving an integrity goal and/or an appearance goal. In some embodiments, the abuse layer can comprise polyamide, ethylene/propylene copolymer (such as, but not limited to, nylon 6, nylon 6/6, amorphous nylon), and/or combinations thereof. In some embodiments, the abuse layer can comprise polymer having a modulus of at least $10^7$ Pascals at room temperature.

As used herein, the term "amide" refers an organic compound that contains the structural group "—$CONH_2$".

The term "arm" as used herein refers to an upwardly protruding extension of pump assembly 15. The arms allow the pump assembly to interlock with carton 5.

As used herein, the terms "barrier" and "barrier layer", as applied to films and/or film layers, refer to the ability of a film or film layer to serve as a barrier to gases and/or odors. Examples of polymeric materials with low oxygen transmission rates useful in such a layer can include: ethylene/vinyl alcohol copolymer (EVOH), polyvinylidene dichloride (PVDC), vinylidene chloride copolymer such as vinylidene chloride/methyl acrylate copolymer, vinylidene chloride/vinyl chloride copolymer, polyamide, polyester, polyacrylonitrile (available as Barex™ resin), or blends thereof. Oxygen barrier materials can further comprise high aspect ratio fillers that create a tortuous path for permeation (e.g., nanocomposites). Oxygen barrier properties can be enhanced by the incorporation of an oxygen scavenger, such as an organic oxygen scavenger (e.g., comprising poly(ethylene/methyl acrylate/cyclohexene methyl acrylate, with or without a transition metal catalyst). In some embodiments, metal foil, metallized substrates (e.g., metallized polyethylene terephthalate (PET), metallized polyamide, or metallized polypropylene), or coatings comprising SiOx or AlOx compounds can be used to provide low oxygen transmission to the disclosed package.

As used herein, the term "bottom face" refers to the face of the disclosed carton that would rest on a solid surface, such as a countertop. The term "top face" refers to the face opposite the bottom face.

As used herein, the term "bottom side" refers to the face of the disclosed pump assembly that would rest on a solid surface, such as a countertop. The term "top side" refers to the face opposite the bottom side.

As used herein, the term "bulk layer" refers to any layer of a film that is present for the purpose of increasing the abuse-resistance, toughness, modulus, etc., of a film. In some embodiments, bulk layers can comprise polyolefin; in some embodiments, at least one member selected from the group comprising ethylene/alpha-olefin copolymer, ethylene/alpha-olefin copolymer plastomer, low density polyethylene, and linear low density polyethylene.

The term "carton", as used herein, refers to any type of box or other container that can be used to house a pouch of the presently disclosed subject matter. Cartons are typically made of corrugated cardboard, but can also be made of sheet molding compound, thin gauge metal, and/or any of a wide variety of other suitable materials known to those of ordinary skill in the art.

The term "connector" as used herein refers to a segment that connects connecting arms 85, 90. The connector interacts with second cutout 55 of carton 5.

As used herein, the term "cut out" refers to a hole, slit, or other void in the carton of the disclosed dispensing system.

As used herein, the term "dispenser" refers to a body defining a reservoir containing a quantity of pumpable material typically sufficient for a number of repeated applications by a user.

The term "dispensing mechanism" refers to any of a wide variety of units that function to dispense a packaged product. Dispensing mechanisms can include (but are not limited to) spigots, siphons, pumps, taps, nozzles, hoses, or combinations thereof.

As used herein, the term "film" includes, but is not limited to, a laminate, sheet, web, coating, and/or the like, that can be used to package a product. The film can be a rigid, semi-rigid, or flexible product, and can be adhered to a non-polymeric or non-thermoplastic substrate such as paper or metal to form a rigid, semi-rigid, or flexible product or composite. The FS laminates, such as FS 7055, sold by Sealed Air Corporation through the Cryovac Division, are examples of packaging materials suitable for the VFFS process. Such laminates are described in U.S. Pat. No. 4,746,562 to Fant, incorporated herein in its entirety by reference thereto. An alternative laminate that can be used in accordance with the presently disclosed subject matter is SCLAIR™ sealant film, an ethylene/alpha-olefin copolymer marketed by DuPont Canada, and described in U.S. Pat. No. 4,521,437 to Storms, incorporated herein in its entirety by reference thereto. Any of a wide variety of other films and laminates useful for dry or wet fluid packaging are available and can be used with the presently disclosed dispensing system.

As used herein, the term "front face" refers to the face of the disclosed carton that is proximate to the dispensing mechanism and thus can be the side facing the user. As used herein, the term "rear face" refers to the face of the disclosed system that is opposite the front face.

As used herein, the term "olefin" refers to any one of a class of monounsaturated, aliphatic hydrocarbons of the general formula $C_nH_{2n}$, such as ethylene, propylene, butane, and the like. In some embodiments, the term can also include aliphatics containing more than one double bond in the molecule such as a diolefin or diene, e.g., butadiene.

As used herein, the term "oriented" refers to a polymer-containing material that has been stretched at an elevated temperature (the orientation temperature), followed by being "set" in the stretched configuration by cooling the material while substantially retaining the stretched dimensions. Upon subsequently heating unrestrained, unannealed, oriented polymer-containing material to its orientation temperature, heat shrinkage is produced almost to the original unstretched, i.e., pre-oriented dimensions. More particularly, the term "oriented", as used herein, can refer to oriented films, wherein the orientation can be produced in one or more of a variety of manners.

The term "piercing fitment" encompasses the broad range of penetration elements known in the art.

As used herein, the term "polymer" (and specific recited polymers) refers to the product of a polymerization reaction, and is inclusive of homopolymers, copolymers, terpolymers, etc.

As used herein, the term "polymerization" can be inclusive of homopolymerizations, copolymerizations, terpolymerizations, etc., and can include all types of copolymerizations such as random, graft, block, etc. In general, the polymers in the films of the presently disclosed pouches can be prepared in accordance with any suitable polymerization process, including slurry polymerization, gas phase polymerization, high pressure polymerization processes, and the like.

The term "pouch" as used herein includes a pouch, a bag, or like containers, either pre-made or made at the point of bagging.

As used herein, the term "pouch fitment" refers to a means for accessing a container (such as a pouch) and can include, without limitation, valves, ports, port enclosure assemblies, and other means for accessing a pouch. Pouch fitments provide ports for establishing fluid communication between the contents of a pouch and the outside environment.

As used herein, the term "pumpable" refers to the ability of a composition to be transported by gravity or by conventional mechanical or pneumatic pumping means from a storage vessel, such as a pouch.

As used herein, the term "seal" refers to any seal of a first region of a film surface to a second region of a film surface, wherein the seal is formed by heating the regions to at least their respective seal initiation temperatures. The heating can be performed by any one or more of a wide variety of manners, such as using a heated bar, hot air, infrared radiation, radio frequency radiation, etc.

As used herein, the term "side face" refers to a face of the disclosed carton that is adjacent to both the front face and the rear face, and is neither the top nor bottom face.

As used herein, the term "support arm" refers to the arm of pump assembly 15 that houses support means 105. In some embodiments, the support arm can house a dispensing means. In some embodiments, the support arm can be positioned adjacent to the front face of carton 5.

As used herein, the term "support means" refers to a protrusion on support arm 100 of the pump assembly that can be positioned into third cut out 60. Although support means 60 is depicted as rectangular in shape in the figures, one of ordinary skill in the art would recognize that any shape can be used, so long as support means 105 can be positioned therein.

As used herein, the phrase "tie layer" refers to any internal film layer having the primary purpose of adhering two layers to one another. In some embodiments, tie layers can comprise a non-polar or slightly polar polymer having a polar group grafted thereon. In some embodiments, tie layers can comprise at least one member selected from the group consisting of: polyolefin and modified polyolefin, e.g., ethylene-vinyl acetate copolymer, modified ethylene-vinyl acetate copolymer, heterogeneous and homogeneous ethylene alpha olefin copolymer, and modified heterogeneous and homogeneous ethylene alpha olefin copolymer; more preferably, tie layers can comprise at least one member selected from the group consisting of anhydride grafted linear low density polyethylene, anhydride grafted low density polyethylene, homogeneous ethylene alpha olefin copolymer, and anhydride grafted ethylene-vinyl acetate copolymer.

Although the majority of the above definitions are substantially as understood by those of skill in the art, one or more of the above definitions can be defined hereinabove in a manner differing from the meaning as ordinarily understood by those of skill in the art, due to the particular description herein of the presently disclosed subject matter.

III. The Disclosed Pouch

III.A. Pouch Materials

Pouch 10 can be made from any suitable material, and in some embodiments can be made from a polymeric material, with a thickness of between about 0.1 and 100 mils. However, the film used to construct pouch 10 can have any total thickness desired, so long as the film provides the desired properties, e.g., optics, modulus, seal strength, etc., for the particular packaging operation in which the film is used.

In some embodiments film materials suitable for use in pouch 10 can include, but are not limited to, olefin or amide polymers or copolymers. The film can be manufactured by polymeric film-forming processes known in the art (e.g., tubular or blown-film extrusion, coextrusion, extrusion coating, flat or cast film extrusion, horizontal form-fill-seal, vertical form-fill-seal, and the like). A combination of these processes can also be employed.

For example, in some embodiments, the disclosed film can be manufactured using vertical form/fill/seal (VFFS) packaging systems. Such VFFS systems are well known to those of ordinary skill in the art. In such a process, lay-flat thermoplastic film is advanced over a forming device to form a tube, a longitudinal (vertical) fin or lap seal is made, and a bottom end seal is made by transversely sealing across the tube with heated seal bars. A product is introduced into the formed tubular film. The pouch is then completed by sealing the upper end of the tubular segment, and severing the pouch from the tubular film above it. The process can be a two-stage process where the creation of a transverse heat seal occurs at one stage in the process, and then, downstream of the first stage, a separate pair of cooling/clamping means contact the just-formed transverse heat seal to cool and thus strengthen the seal. In some VFFS processes, an upper transverse seal of a first pouch, and the lower transverse seal of a following pouch, are made, and the pouches cut and thereby separated between two portions of the transverse seals, without the need for a separate step to clamp, cool, and cut the seals. In conventional VFFS processes, the product is typically a flowable product that is introduced through a central, vertical fill tube to the formed tubular film.

Figure 3:
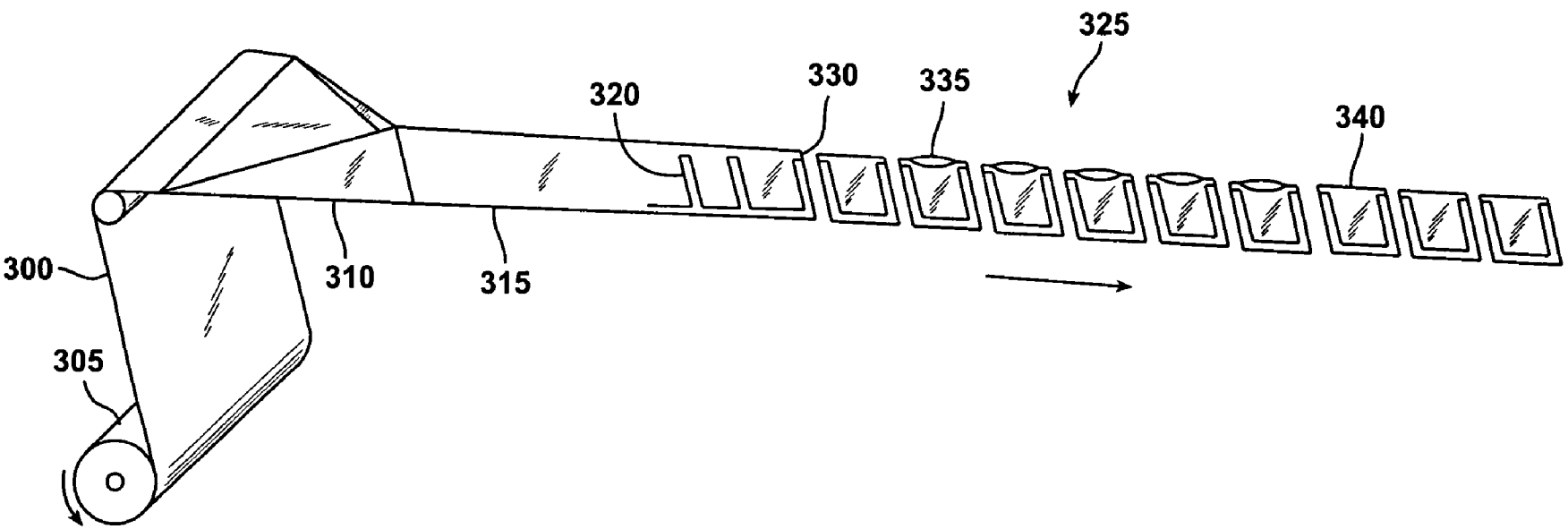
FIG. 3 is a perspective view of a horizontal form/fill/seal (HFFS) packaging system.

In some embodiments, the disclosed film can be manufactured using horizontal form/fill/seal (HFFS) packaging systems. HFFS packaging systems are well known to those of ordinary skill in the packaging industry. An example of the HFFS process and apparatus is illustrated in FIG. 3. Web 300 is unwound from roll 305, then advanced to forming plow 310 to convert the layflat web to a folded web (typically centerfold film). Thus, one side or edge of the pouches to be constructed comprises fold 315. The fold can be optionally sealed as depicted, or can remain as a folded edge of the pouch. Side seals 320 are constructed to define a plurality of vertically arranged pouches 325. Each pouch is cut off from the trailing edge of the web by an appropriate cutting mechanism (not shown) at position 330, pumpable product (not shown) is inserted into open mouth 335 of each pouch, and the pouch mouth closed by sealing mechanism 340, such as a heat seal, or any other suitable means.

The film used to construct pouch 10 can be oriented or non-oriented. In some embodiments, the film can be oriented in either the machine direction (i.e., longitudinal), the transverse direction, or in both directions (i.e., biaxially oriented) in order to enhance the optics, strength, and durability of the film. If the film is oriented, it can be heat set or annealed after orientation to reduce the heat shrink attribute to a desired level or to help obtain a desired crystalline state of the film.

In some embodiments, the film can comprise one or more polymeric materials in a barrier layer to serve as a barrier to gases and/or odors. Such barrier layers can include, but are not limited to, ethylene/vinyl alcohol copolymer (EVOH), polyvinylidene dichloride (PVDC), vinylidene chloride copolymer such as vinylidene chloride/methyl acrylate copolymer, polyamide, polyester, polyacrylonitrile (available as Barex™ resin), or blends thereof. Oxygen barrier materials can further comprise high aspect ratio fillers that create a tortuous path for permeation (e.g., nanocomposites). The oxygen barrier of materials can be further enhanced by the incorporation of an oxygen scavenger.

In some embodiments, the disclosed film can comprise one or more bulk layers to increase the abuse-resistance, toughness, modulus, etc., of the film. In some embodiments, the bulk layer can comprise polyolefin, including (but not limited to) at least one member selected from the group comprising ethylene/alpha-olefin copolymer, ethylene/alpha-olefin copolymer plastomer, low density polyethylene, and linear low density polyethylene.

In some embodiments, the disclosed film can include one or more tie layers. Such tie layers can include, but are not limited to, one or more polymers that contain mer units derived from at least one of $C_2$-$C_{12}$ alpha olefin, styrene, amide, ester, and urethane. In some embodiments, the tie layer can comprise one or more of anhydride-grafted ethylene/alpha olefin interpolymer, anhydride-grafted ethylene/ethylenically unsaturated ester interpolymer, and anhydride-grafted ethylene/ethylenically unsaturated acid interpolymer.

In some embodiments, the film can comprise one or more abuse layers that serve to resist abrasion, puncture, and other potential causes of reduction of package integrity, as well as potential causes of reduction of package appearance quality. Particularly, the film can have the required degree of tolerance to pinching and exposure to sharp edges, resulting from contact with the edges of the panels of carton 5. Abuse layers can comprise any polymer, so long as the polymer contributes to achieving an integrity goal and/or an appearance goal. In some embodiments, the abuse layer can comprise at least one member selected from the group consisting of polyamide, ethylene/propylene copolymer; in some embodiments, nylon 6, nylon 6/6, amorphous nylon, and ethylene/propylene copolymer.

The polymeric components used to fabricate films according to the presently disclosed subject matter can also comprise appropriate amounts of other additives normally included in such compositions. For example, slip agents (such as talc), antioxidants, fillers, dyes, pigments, radiation stabilizers, antistatic agents, elastomers, and the like can be added to the disclosed films.

There is generally no limit to the number of layers used for the film structure of pouch 10 provided that the various functional requirements are met. Accordingly, the film can comprise 1, 2, 3, 4, 5, 6, 7, 8, 9, 10, 11, 12, 13, 14, 15, 16, 17, 18, 19, or 20 layers.

In some embodiments, it is envisaged that pouch 10 can be produced in various different sizes, depending on the product to be packaged. For example, a 0.5 pint to 5 gallon size (the dimensions of the pouch being adjusted to give the appropriate volume) can be fabricated. Thus, in some embodiments, pouch 10 can be prepared in 0.5, 1, 1.5, 2, 2.5, 3, 3.5, 4, 4.5, 5, 5.5, 6, 6.5, 7, 7.5, or 8 pint (1 gallon) sizes. In addition, 1, 1.5, 2, 2.5, 3, 3.5, 4, 4.5, 5, 5.5, 6, 6.5, 7, 7.5, 8, 8.5, 9, 9.5, and 10 gallon pouch sizes can also fall within the scope of the presently disclosed subject matter. Larger or smaller volumes are also contemplated and can be included within the scope of the presently disclosed subject matter. In addition, as would be readily apparent to one of ordinary skill in the art, the gallon measurements can easily be converted to liter or other suitable measurements.

Those skilled in the art will understand, after a review of the present application, that the particular shape and size of the pouch and the location of the fitment can be selected as needed to suit the particular product to be packaged and/or to suit existing carton and pump systems.

III.B. Pouch Fitment 65

Figure 4A:
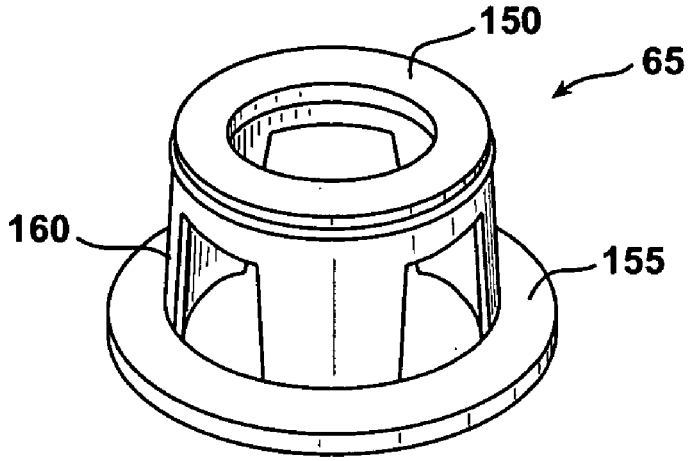
FIG. 4*a* is a perspective view of a pouch fitment of the disclosed dispensing system.

Pouch 10 comprises pouch fitment 65 disposed on one face of the pouch. A representative pouch fitment is depicted in FIG. 4*a*. As would be appreciated by those of ordinary skill in the art, any of a wide variety of pouch fitments known in the art can be used, so long as the fitment is adhered to a pouch and is capable of being pierced by a corresponding piercing fitment.

Figure 4B:
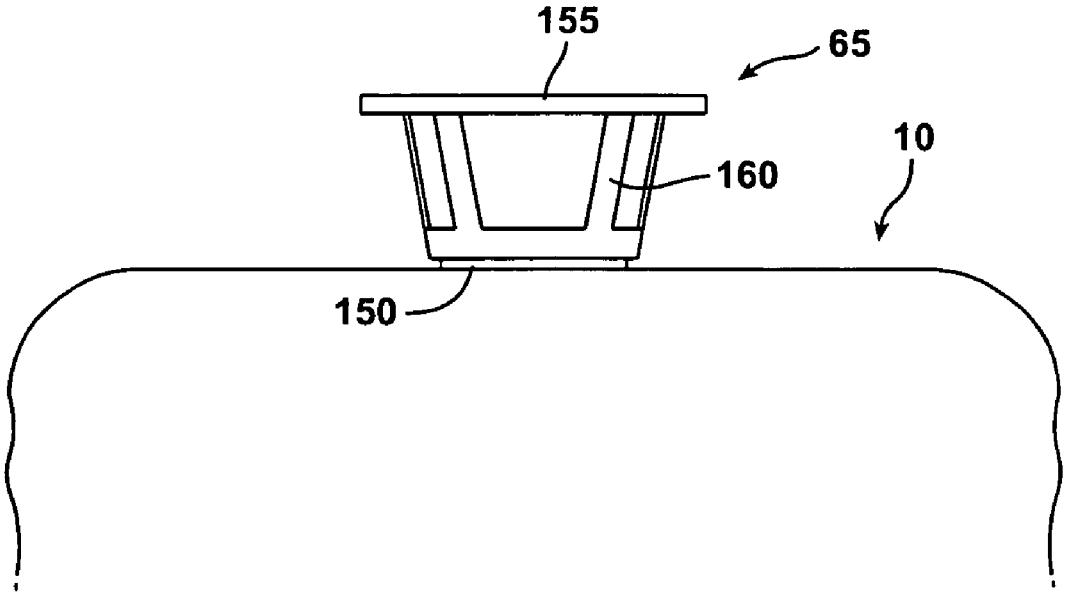
FIG. 4*b* is a side elevation view of the pouch fitment of the disclosed dispensing system.

As illustrated in FIG. 4*a*, in some embodiments pouch fitment 65 comprises inner ring 150 that is affixed to one face of pouch 10 using any suitable means (such as, for example, an adhesive and/or by heat sealing). Accordingly, base 160 and outer ring 155 both extend from pouch 10, as illustrated in FIG. 4*b*. In order to pierce pouch 10, the piercing element of a piercing fitment pierces the film of pouch 10 in the area spanning inner ring 150. Inner ring 150 and/or outer ring 155 can also be suitably configured to allow a piercing fitment to interlock with pouch fitment 65 using methods well known in the art.

In some embodiments, pouch fitment 65 can be supported by panels that form bottom face 45 of carton 5. As set forth in more detail herein below, the panels contain notches that form first cut out 50 when the panels are adhered together. First cut out 50 is of sufficient size to house inner ring 150 and base 160, but is too small to house outer ring 155. Thus, outer ring 155 is supported and maintained exterior to carton 5 by first cut out 50.

III.C. Pouch Configuration

Figure 5B:
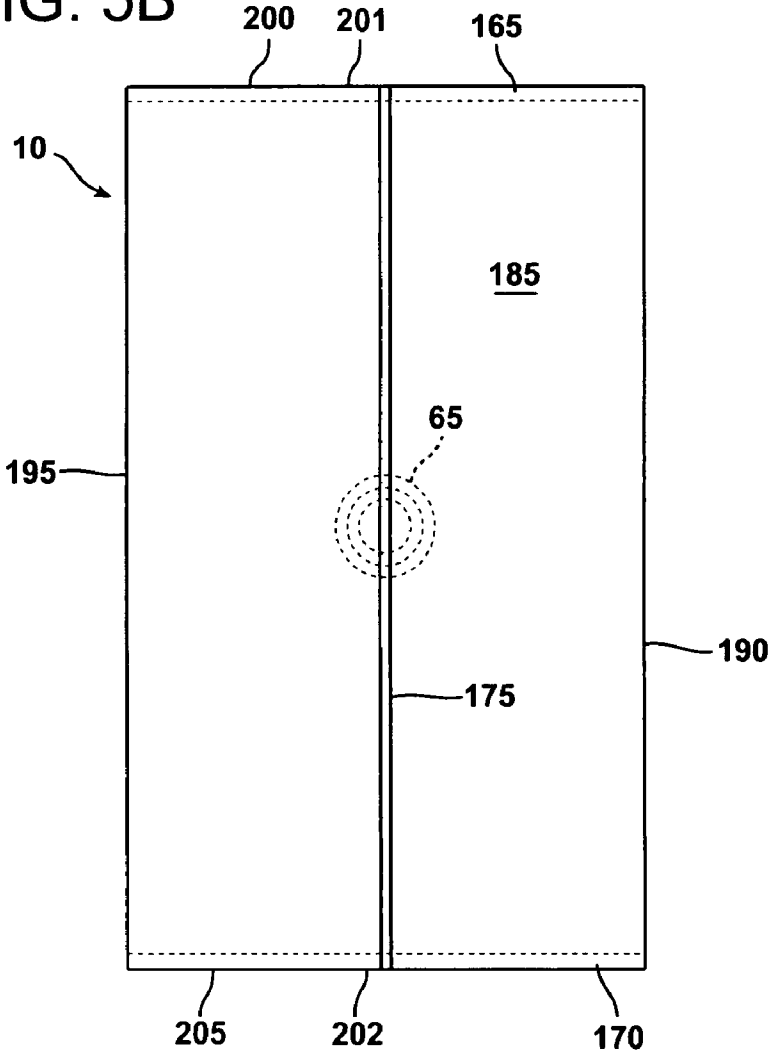
FIG. 5*b* is a bottom plan view of the pouch of FIG. 5*a*.
Figure 5A:
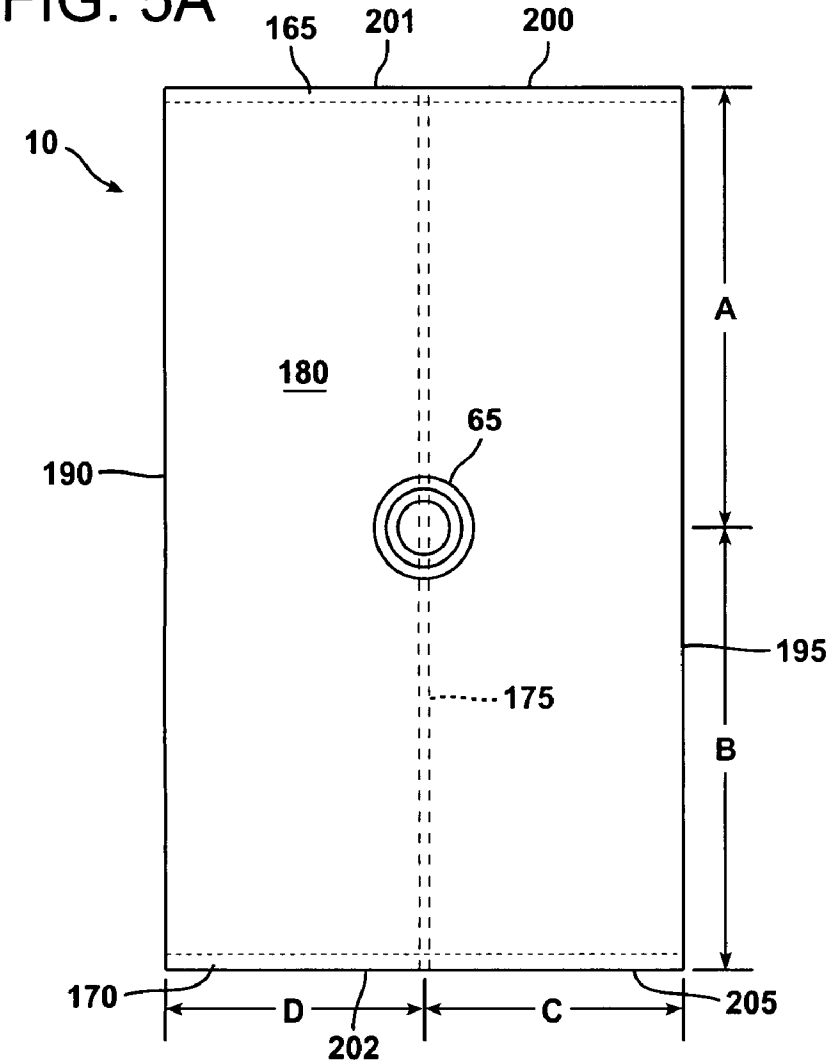
FIG. 5*a* is a top plan view of a pouch of the disclosed dispensing system.

As depicted in FIGS. 5*a* and 5*b*, pouch 10 can include first transverse seal 165, second transverse seal 170, and longitudinal seal 175. The various seals can be made by heat sealing, radio frequency, ultrasonic sealing, or using any of a wide variety of methods known to those of ordinary skill in the art. The width of the seals can be from about 2 to about 20 millimeters, although other sealing geometries are possible and within the scope of the presently disclosed subject matter. The pouch can include first wall 180 having an outer surface and an inner surface, and second wall 185 having an outer surface and an inner surface. In some embodiments, first wall 180 comprises pouch fitment 65. However, although not depicted in the Figures, one of ordinary skill in the art would recognize that second wall 185 can comprise pouch fitment 65.

Pouch 10 can also include first side edge 190, second side edge 195, first transverse edge 200, and second transverse edge 205. Pouch 10 also includes first end 201 and second end 202. Pouch fitment 65 is attached to the outside of first wall 180 and can be substantially centrally disposed between the first and second transverse edges 200, 205 of the pouch. First and second transverse edges 200, 205 are defined by the outer longitudinal extremities of first transverse seal 165 and second transverse seal 170, respectively. In some embodiments, unsealed pouch material can be present between the outer edges of a transverse seal and the actual respective transverse edges of the pouch itself. Such embodiments are also contemplated within the scope of the presently disclosed subject matter.

As represented in FIG. 5*a*, in some embodiments, pouch fitment 65 can be disposed approximately halfway between first and second transverse edges 200, 205 such that distances "A" and "B" are approximately equal in length. However, in some embodiments, the distances "A" and "B" can be of unequal lengths, such as in J-fold pouches or other pouches well known in the art. The practical limits are those imposed by carton 5. It should be noted that the width of pouch 10 represented by lengths "C" and "D" is such that C can be approximately equal to D. It will be appreciated that lengths A and B and C and D are not always approximately equal in length and can vary according to the specific use desired.

Thus, in some embodiments, pouch fitment 65 can be somewhat off-center laterally, i.e., distance "C" can be less than or greater than distance "D". In some embodiments, the difference in distance between "C" and "D" can be less than or equal to 50%; in some embodiments, less than or equal to 40%; in some embodiments, less than or equal to 30%; in some embodiments, less than or equal to 20%; and in some embodiments, less than or equal to 10%. Thus, the difference in distance between the fitment and the first transverse seal and the second transverse seal is less than or equal to about 50%, 40%, 30%, 20%, or 10% of the total distance between the seals.

Thus, for example, if "C" is 7.5 centimeters long, "D" can be 7.5 centimeters long as well. However, in some embodiments, "C" can be 9 centimeters long, while "D" is 6 centimeters long, corresponding to a difference in length, between "C" and "D", of 50%. The practical limits can be those imposed by the pump used and/or the effectiveness of the pouch fitment in allowing the flow of pumpable material from the pouch, through the fitment, and out through the pump. For example, in some embodiments, it is envisioned that pouch fitment 65 can be disposed on or near a side edge. Particularly, in some embodiments, the distance in difference between the fitment and the first side edge and the distance between the fitment and the second side edge is less than or equal to about 50% of the total distance between the first and second side edges.

In practice, pouch 10 is positioned (i.e., folded) in carton 5 such that pouch fitment 65 is disposed on an outer surface of the pouch and is accessible on bottom face 45 of carton 5. In some embodiments, pouch 10 can be secured within carton 5 by the use of any of a wide variety of adhesives. Particularly, adhesive can be applied to the outer surface of pouch 10 (i.e., the pouch surface in contact with carton 5) and/or adhesive can be applied to the inner surface of carton 5 (i.e., the carton surface in contact with pouch 10). Such adhesives are well known to those of ordinary skill in the art.

In addition, the position of pouch 10 in carton 5 can be maintained by properly positioning pouch fitment 65 into first cut out 50 of carton 5. First cut out 50 can be constructed using means well known in the art, such as, for example, laser cutting means, perforations, and the like. In some embodiments, first cut out 50 can be constructed by forming 2 U-shaped notches on opposite faces of 2 panels that join at bottom face 45. The panels can then be adhered together such that the 2 U-shaped cut outs form a hole (first cut out 50) in the center of the panels. Although first cut out 50 is depicted as a circle in the figures, the shape of the cut out is not so limited. Rather, as would be appreciated by those of ordinary skill in the art, first cut out 50 can be of any suitable shape (i.e., square, oval, and the like) so long as it is small enough to house inner ring 150 and base 160 of the pouch fitment, but is too small to house outer ring 155.

Figure 6:
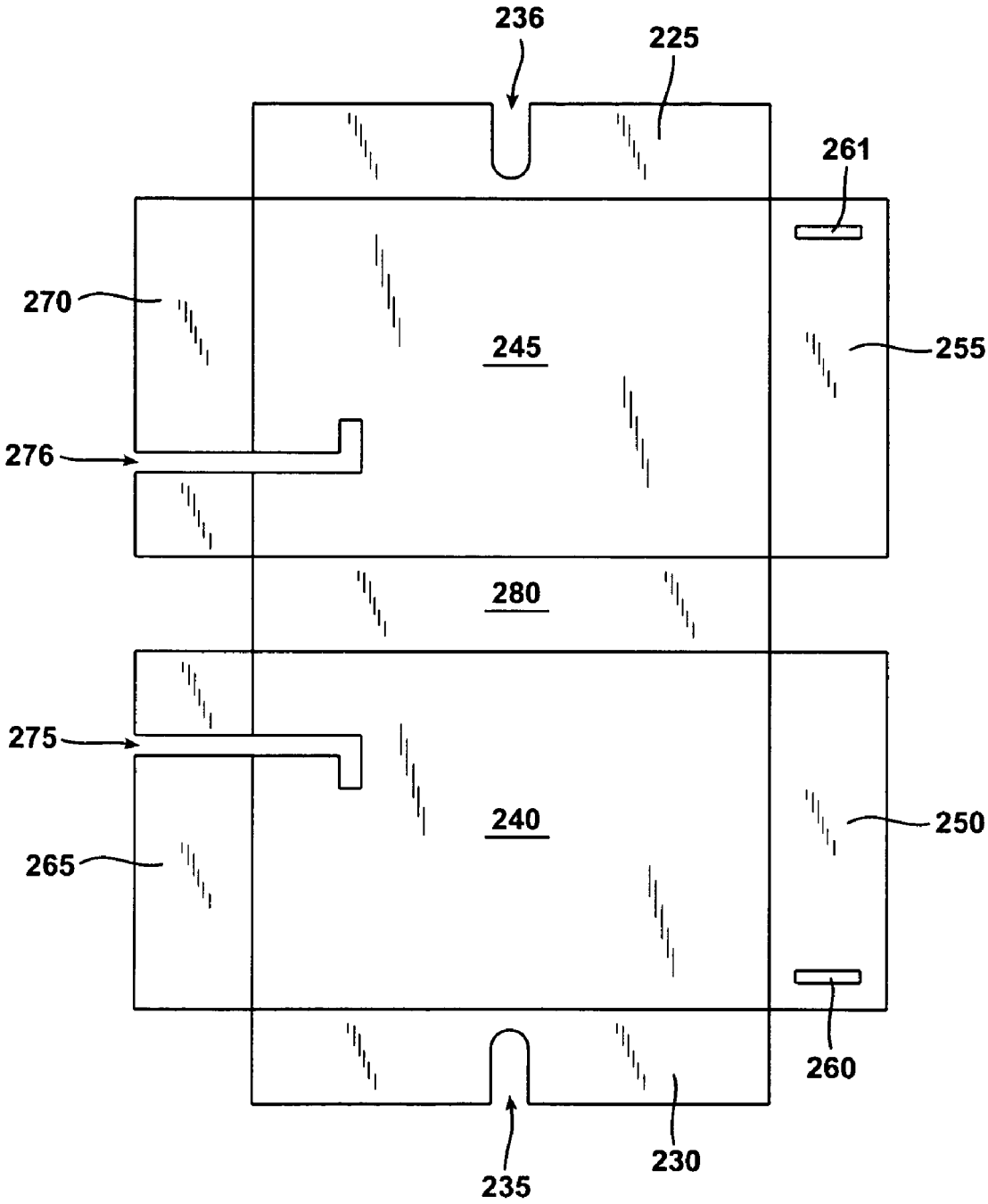
FIG. 6 is a top plan view of a representative carton blank that can be used to construct the disclosed carton.

As illustrated in the carton blank of FIG. 6, panels 225 and 230 contain notches 236 and 235, respectively, that form first cut out 50 when the panels are adhered together to form bottom face 45 of carton 5. Panels 240 and 245 form side faces 20 and 25 of carton 5 when assembled. Panels 250 and 255 contain second notches 260 and 261, respectively, that form third cut out 60 when the panels are adhered together to form front face 35 of carton 5. Panels 265 and 270 are adhered together to form rear face 30 of carton 5. Third notches 275 and 276 are located on panels 265 and 270, respectively, as well as on panels 240 and 245 to form second cut out 55. Panel 280 forms top face 40 of carton 5. One of ordinary skill in the art would recognize that any of a wide variety of carton blanks can be used, so long as the blank comprises first, second, and third cut outs 50, 55, and 60, respectively.

Figure 7:
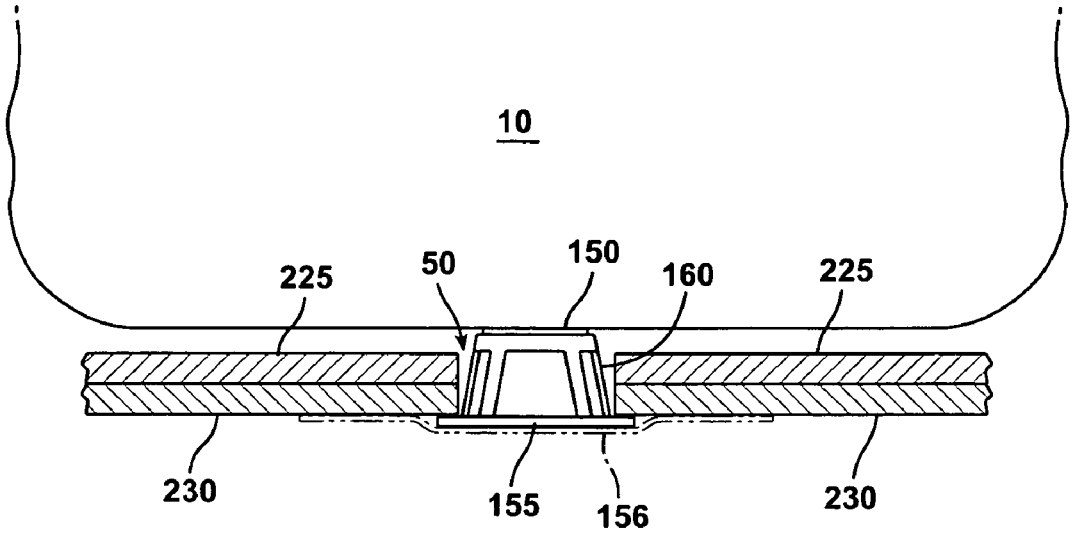
FIG. 7 is an enlarged fragmentary view taken of the pouch fitment disposed within the carton.

Notches 235 and 236 are of sufficient size such that when panels 225 and 230 are adhered together, first cut out 50 is sized to house inner ring 150 and base 160, but is too small to house outer ring 155 of the pouch fitment. FIG. 7 depicts pouch fitment 65 housed within carton 5. Outer ring 155 is exterior to the carton (i.e., first cut out 50 is too small to allow outer ring 155 to pass through), while inner ring 150 and base 160 are housed within carton 5.

In some embodiments, before the piercing of pouch 10, the contents of the pouch can be maintained in sterile conditions. Sterile conditions can be obtained by known means, such as, for example, by sterilization of pouch 10, pouch fitment 65, and/or subsequent aseptic filling of the pouch with microbiologically sensitive product. In some embodiments, sterilization can be carried out by irradiation processes, although other means (such as heat sterilization) are envisaged.

Figure 8:
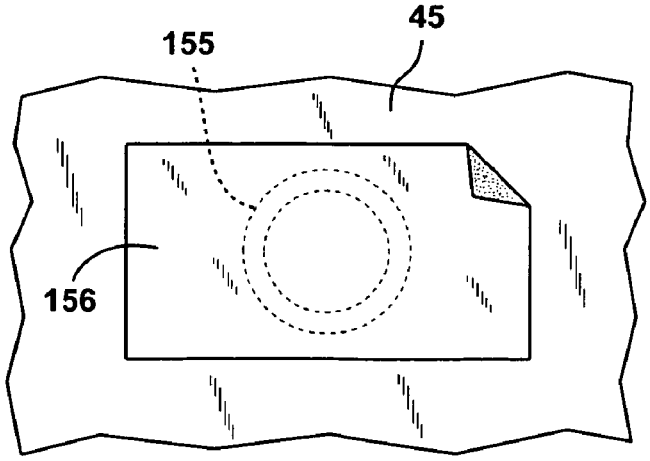
FIG. 8 is an enlarged fragmentary view of a covering used to protect the pouch fitment.

In some embodiments, it can be beneficial to add one or more coverings 156 to the exterior of pouch fitment 65 in carton 5 for sanitation purposes. For example, a segment of label, tape, or other protective means can be removably secured to the exterior portion of pouch fitment 65 that extends from carton 5 (i.e., outer ring 155). The covering offers a protection to pouch fitment 65 (and thus the contents of the pouch) and protects it from exposure to dirt, oil, and the like during shipping of the carton and/or system. Prior to use, users can easily remove covering 156 to expose pouch fitment 65 for proper piercing of pouch 10. FIG. 8 illustrates one embodiment of covering 156 on bottom face 45 of carton 5.

IV. The Dispensing Carton

IV.A. Carton Materials

Carton 5 can be suitably formed by folding and sealing any of a wide variety of pre-cut blanks, which can be manufactured in bulk according to means well known in the art. For example, FIG. 6 depicts one such suitable blank.

Suitable substrates from which the blank can be constructed include (but are not limited to) coated or uncoated cardboard or paperboard, which can include as a component bleached or unbleached pulp; wood; metal; plastic such as polyolefin, polycarbonate, vinyl polymer, polyester, and/or acrylic; molded fiber pulp or any combination thereof. Representative examples of these types of substrates are solid bleached sulfate paperboard (SBS), clay-coated newsback (CCNB), coated solid unbleached sulfate (SUS), multi-ply folding box board or kraft paperboard, or combinations thereof.

In some embodiments, the blank for forming carton 5 can be comprised of multiple layers of material laminated together to form a substrate. The laminated substrate can be formed by extrusion coating, extrusion lamination, adhesive lamination, dry lamination, solvent coating, aqueous coating, or combinations thereof. For additional barrier properties, oxygen scavengers or other fillers or additives can be incorporated into one or more layers of the laminate.

In some embodiments, the blank can comprise materials suitable for printing, such that any desired graphics or printed materials can be placed upon the carton. Such graphics or printed materials can include, but are not limited to, manufacturer's name, pouch contents, and the like. Such printing methods are known to those of ordinary skill in the art.

IV.B. Carton Configuration

The dimensions of carton 5 are not limited, and can be dictated by the dimensions of pouch 10 and/or pump assembly 15. Pouch 10 can be positioned in carton 5 in a lay flat arrangement or can be folded, so long as pouch fitment 65 is accessible through first cut out 50 located on bottom face 45 of carton 5. In some embodiments, a conventional unfolded blank can be used to construct a single piece tray-style box container. However, it will be understood that cartons with parts that are molded separately and then joined by means known in the art can also be included in the presently disclosed subject matter. In some embodiments, the blank from which carton 5 is formed can be rectangular in shape, have an overall planar configuration, and include top, bottom, front, rear, and side edges. One of ordinary skill in the art would readily appreciate that a variety of blanks of various shapes can be used to form carton 5 in accordance with the presently disclosed subject matter.

The carton blank can be scored or perforated scored with fold lines to provide a plurality of panels. In some embodiments, the panels of carton 5 can be secured by, for example, applying hot-melt resin glue at specific locations, folding the body at the plurality of fold lines and compressing at the glued panel locations. Thus, upon folding the side panels upward to the perpendicular position to meet the end panels, the ribbons of hot-melt resin glue on the fold lines come in contact with the exposed edges of the end panels to bring about flute closure or sealing.

Accordingly, the means of sealing the panels can be selected from any appropriate means known in the art, including but not limited to, heat-sealing, ultrasonic welding, applying an adhesive, mechanical locks formed in the blank, or combinations thereof. In the heat-sealing process, a layer of a heat sealable material that has been previously applied to the internal surface of a blank is heated to a temperature at which it is semi-fluid, or tacky. The tacky surfaces are then compressed together such that the heat sealable material on the surfaces fuses to form a seal. In some embodiments, the glue composition can comprise conventional hot melt resin glue, cold set water resistant glue, starch or dextrin formulations, and/or a foaming type hot melt.

As set forth in more detail hereinabove, pouch 10 comprises pouch fitment 65 that is contacted with piercing fitment 80. In order for the pouch fitment to be suitably accessed by piercing fitment 80, carton 5 comprises first cut out 50 on bottom panel 45 of carton 5 to provide such access. First cut out 50 can function to support and keep pouch 10 and pouch fitment 65 secure. Thus, in some embodiments, if a user desires to pierce pouch fitment 65 with piercing fitment 80, the pouch fitment will remain securely in place. Accordingly, the stability of the position of the pouch fitment can be ensured, even after a degree of rough handling in transportation and storage.

In addition, two or more additional cut outs are constructed in carton 5. Particularly, as depicted in FIG. 2*a*, carton 5 comprises second cut out 55 and third cut out 60. Second cut out 55 is located on back face 30 and side faces 20 and 25 to interact and house connector 95 of pump assembly 15. As set forth in more detail herein below, connector 95 initially interacts with second cut out 55. Support means 105 then aligns with third cut out 60 located on front face 35 of carton 5. In some embodiments, it can be desirable to provide additional cuts or slots in carton 5 as a means by which to grip or lift the carton, or to visually inspect the pouch contents or levels of fullness.

In some embodiments, cut outs 50, 55, and 60 can be created from perforated or otherwise weakened knock-out areas in carton 5. Specifically, the corresponding section of the panel of carton 5 can be perforated or weakened to allow for the easy opening and removal of the portions covering the cut outs. The term "perforated", as used herein, can refer to the formation of a series of cuts of a predetermined size and configuration through at least part of the thickness of the substrate. The cuts can be made by any suitable means for achieving the desired length, depth, and/or configuration. In some embodiments, the cuts can be made using a laser-cutting means. For example, the substrate can be at least partially penetrated by light pulses from a 100-800 watt carbon dioxide laser. Other suitable methods for creating cuts in carton 5 would be readily apparent to one of ordinary skill in the art. Thus, portions of carton 5 can be lifted upwardly or downwardly to tear the perforation and thus create first cut out 50, second cut out 55, and/or third cut out 60. In this way, a predefined, perforated area of opening provides a clean and organized means for providing access to pouch fitment 65 and/or for interacting with pump assembly 15.

Figure 9A:
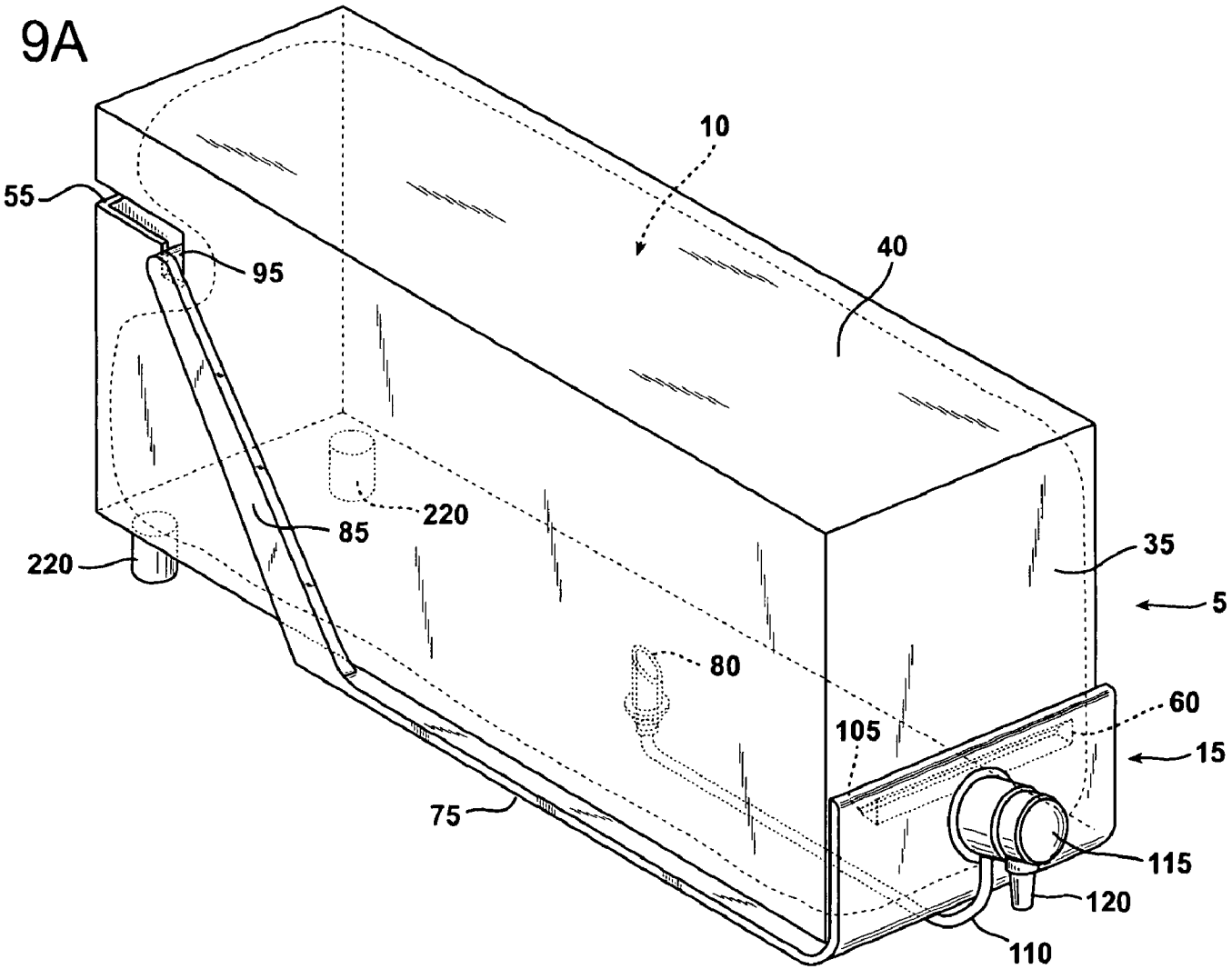
FIG. 9*a* is a perspective view of one embodiment of the disclosed dispensing system.
Figure 9B:
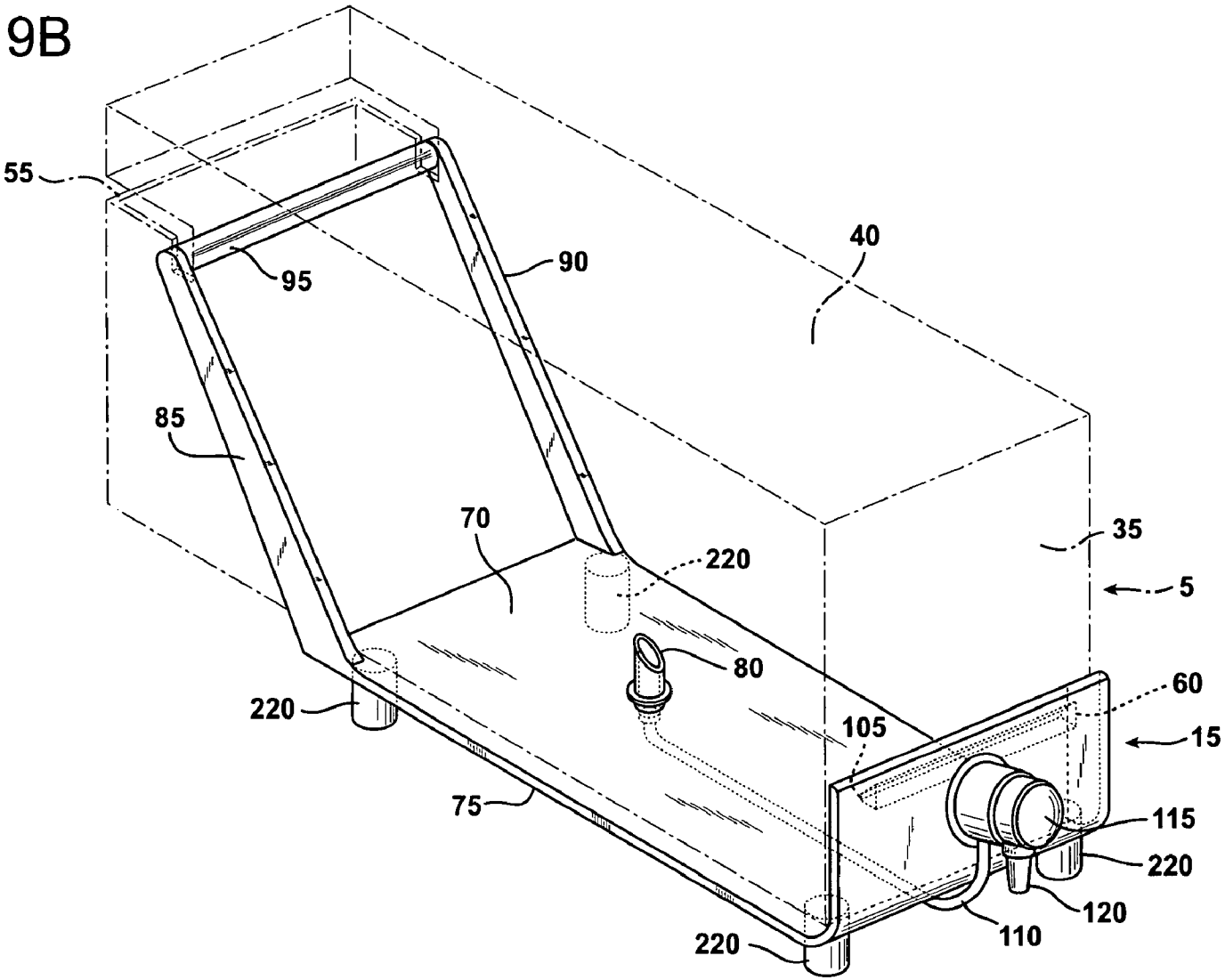
FIG. 9*b* is a perspective view of one embodiment of the disclosed dispensing system.

As depicted in FIGS. 9*a* and 9*b*, in some embodiments, carton 5 can comprise one or more balancing feet 220 to offset the thickness of pump assembly 15 and/or tubing 110. Particularly, in some embodiments, carton 5 can become unsteady once pump assembly 15 is connected thereto as a result of the thickness of the pump assembly. Accordingly, one or more feet 220 can be secured to carton 5 and/or pump assembly 15 to adjust for the unsteadiness. For example, as depicted in FIG. 9*a*, in some embodiments, one or more (e.g., two) feet 220 can be positioned on carton 5 to counterbalance pump assembly 15. In some embodiments, as depicted in FIG. 9*b*, one or more feet (e.g., four) can be positioned on pump assembly 15 to stabilize the dispensing system. Although two and four feet are depicted in FIGS. 9*a* and 9*b*, respectively, it is within the scope of the presently disclosed subject matter that carton 5 and/or pump assembly 15 can have 1, 2, 3, 4, 5, 6, 7, 8, 9, or 10 feet.

Feet 220 can be constructed in any shape and from any material known to those of ordinary skill in the art and can include those materials suitable for constructing carton 5. In addition, feet 220 can be secured to carton 5 and/or pump assembly 15 using any of a number of means well known in the art, including (but not limited to) adhesives. However, the inclusion of feet 220 onto carton 5 and/or pump assembly 15 is optional and it is within the scope of the presently disclosed subject matter that carton 5 and/or pump assembly 15 can be configured without such feet.

V. Pump Assembly 15

V.A. Generally

Pump assembly 15 interacts with carton 5 and pouch 10 to dispense pumpable product housed in the pouch. Particularly, pump assembly 15 comprises piercing fitment 80 that pierces the film within pouch fitment 65 to dispense the pouch contents. In addition, as depicted in FIG. 2*c*, pump assembly 15 comprises connector 95 that interacts with second cut out 55 on rear face 30 of carton 5. Specifically, connector 95 first slides into the horizontal portion of second cut out 55 (i.e., the portion of the cut out that is parallel to bottom face 45 of the carton). Connector 95 then slides up or down (depending on the orientation of second cut out 55) into the vertical portion of second cut out 55 (i.e., the portion of the cut out that is parallel to front face 35 of the carton). The pump assembly 15 rotates to allow piercing fitment 80 to align with pouch fitment 65. Support means 105 is then positioned into third cut out 60 to stabilize the position of pump assembly 15.

Once piercing fitment 80 of pump assembly 15 has pierced pouch fitment 65 and the portion of film within inner ring 150, the pumpable product housed within pouch 10 can be dispensed. To elaborate, when dispensing mechanism 115 of pump assembly 15 is initiated, pumpable product flows from pouch 10, through pouch fitment 65 and piercing fitment 80 and is transported along tubing 110 to dispensing mechanism 115 and through exit port 120 where the pumpable product is dispensed. Exit tubing 110 can run along the top or bottom face of pump assembly 15 to connect to dispensing mechanism 115.

Pump assembly 15 can be made from any suitable rigid or semi-rigid material into a particular shape as dictated by the dimensions of carton 5. Particularly, in some embodiments pump assembly 15 can be constructed from wood, metal, plastic, or combinations thereof. Methods of constructing pump assembly 15 are well known to those of ordinary skill in the art. For example, in some embodiments, plastic injection molding can be used.

V.B. Components

V.B.i. Connecting Arms 89, 90

As depicted in the Figures, connecting arms 85, 90 connect to pump assembly 15 and extend upward from top side 70 to interact with second cut out 55 of carton 5. Particularly, as depicted in FIG. 2*c*, connecting arms 85, 90 are configured to extend up and connect together at connector 95. In use, connector 95 is positioned into the horizontal portion of into second cut out 55. In some embodiments, pump assembly 15 is then repositioned and swung under carton 5 to align pouch fitment 65 with piercing fitment 80. Connector 55 can then be positioned to move vertically upward or downward to allow the piercing fitment and pouch fitment to interact.

V.B.ii. Piercing Fitment 80

Figure 10:
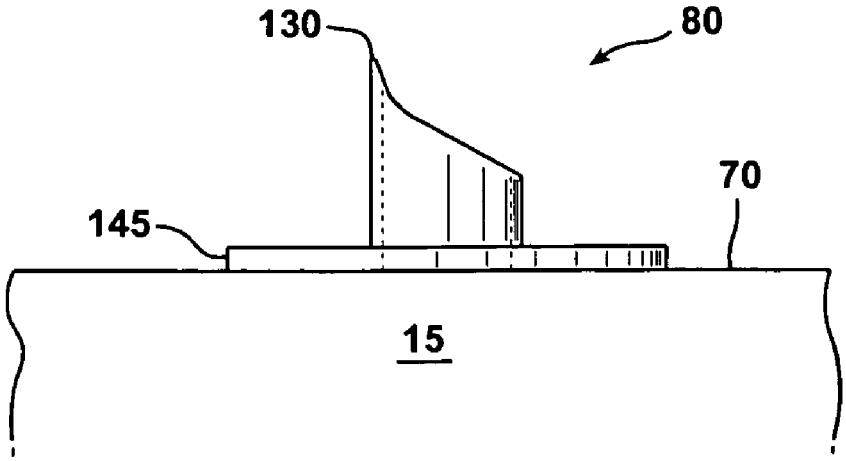
FIG. 10 is an enlarged fragmentary view of a representative piercing fitment.

FIG. 10 illustrates a representative piercing fitment that can be used with pump assembly 15. One of ordinary skill in the art would understand that the piercing fitment depicted in FIG. 10 is one of a wide variety of piercing fitments that are known in the art and that can be used with the presently disclosed pump assembly. As illustrated, piercing fitment 80 comprises piercing element 130 to pierce the pouch film and/or interlock with pouch fitment 65. Thus, piercing fitment 80 can have a conical or piercing portion matched to pouch fitment 65. The piercing fitment can therefore terminate at an angle to facilitate puncturing of the film spanning inner ring 150 of pouch fitment 65. The precise configuration of piercing portion 130 of piercing fitment 80 can vary so long as it interacts with pouch fitment 65 to pierce and dispense pouch contents. In some embodiments, piercing portion 130 comprises a generally cylindrical stem topped with a pointed tip. The exact size and shape of the tip can depend on many factors, including the dimensions of pouch fitment 65, the materials used in the construction of pouch 10, and the type and amount of pumpable product contained therein, among others. Specific values for any of these factors in any embodiment are a matter of engineering design choice.

Piercing fitment 80 can also comprise ledge 145 that can be secured to pump assembly 15 by adhesives or other suitable means. Accordingly, pump assembly 15 comprises piercing portion 130 on top side 70 (the face positioned toward pouch fitment 65). In some embodiments, piercing portion 130 and/or ledge 145 are constructed of sufficiently rigid material, such as (but not limited to) plastic, wood, metal, and the like. However, it is within the scope of the presently disclosed subject matter that piercing portion 130 can be constructed of sufficiently flexible material to allow the piercing fitments to be precisely guided into the pouch fitment, even if the fitments are not directly aligned. For example, a flexible piercing portion enables the piercing fitment to adaptably align with pouch fitment 65 to pierce the pouch, even if the pouch fitment and piercing fitment are not exactly aligned. Rather, the piercing portion can flexibly bend to accommodate the offset between the fitments to pierce the pouch.

In some embodiments, once piercing fitment 80 is inserted into pouch fitment 65, the two can become locked together via a friction or snap-fitting mechanism. Such a mechanism prevents the piercing fitment from being pulled out of the pouch fitment once the assembly is in a dispensing state and also maintains a tight fit to prevent unwanted spillage of the pouch contents. Pumpable product can then be dispensed via tubing 110 and dispensing mechanism 115. In some embodiments, dispensing mechanism 115 can comprise a spigot, siphon, pump, tap, nozzle, hose, or combinations thereof.

Thus, in some embodiments, the fitment assembly can comprise a locking mechanism adapted to secure piercing fitment 80 to pouch fitment 65 as a result of a pushing force exerted on pouch fitment 65 when pump assembly 15 is seated onto carton 5. The locking mechanism can comprise a recessed portion on the piercing end of piercing fitment 80 adapted to cooperate with the elements of the pierceable portion of pouch fitment 65 to prevent unwanted spillage. Thus, in some embodiments, fitments 65, 80 can interlock to stabilize and create an airtight and/or liquid-tight seal to prevent leakage at the fitment site.

V.B.iii. Support Means 105

Support means 105 is located in support arm 100 of pump assembly 15. Specifically, support arm 100 follows the line of carton 5 and is positioned adjacent to front face 35 of carton 5. Either before or after piercing fitment 80 has interlocked with pouch fitment 65, pump assembly 15 can be stabilized and maintained in proper position by inserting support means 105 into third cut out 60. Thus, in some embodiments, the dimensions of support means 105 and third cut out 60 are closely matched such that when support arm 100 and piercing fitment 80 are in proper position, support means 105 can be easily maneuvered into third cut out 60 by a user.

V.B.iv. Dispensing Mechanism 115

A delivery device can be associated with the disclosed dispensing system to selectively dispense the contents of pouch 10. Such a delivery device suitable for use with the disclosed dispensing system is not limited and can include any of a wide variety of commercially available models.

For example, as depicted in the Figures, dispensing mechanism 115 can be housed within pump assembly 15. To elaborate, in some embodiments, tubing or other similar means can be used to connect piercing fitment 80 along the length of pump assembly 15 to a dispensing mechanism in support arm 100. When a button or other similar means is pushed or activated, the dispensing mechanism can control the dispensing of the pumpable product from pouch 10. The dispensing mechanism can have any valve design convenient for dispensing fluid on demand. In some embodiments, dispensing mechanism 115 can be a simple button-operated or lever-operated valve that defaults to a closed position (through use of a spring or other biasing mechanism), and is opened only when the button or lever is moved against the biasing mechanism. Such an embodiment of a lever-operated valve is commonly used on coffee and water dispensers for home and commercial use. Dispensing mechanisms encompassing valves of various designs useful for dispensing from the dispensing apparatus are well known to those of ordinary skill in the art.

Figure 11:
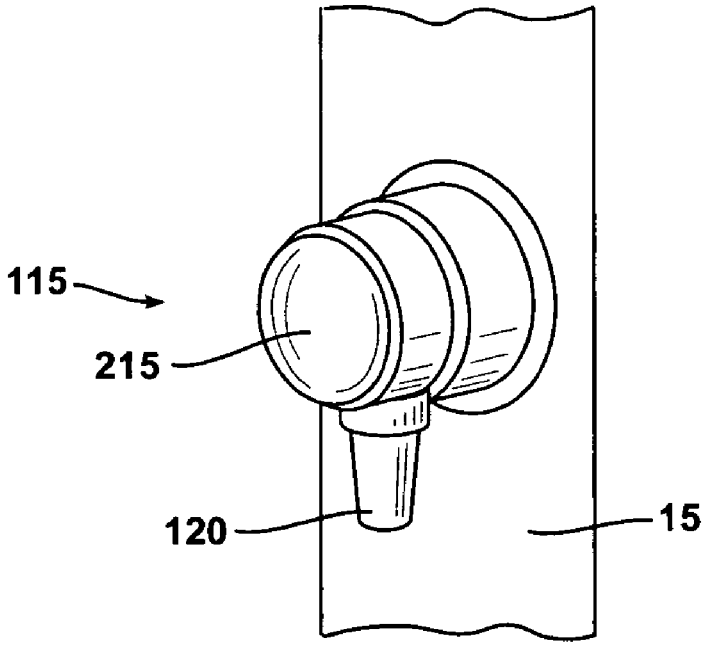
FIG. 11 is an enlarged fragmentary view of a representative dispensing means.

For example, FIG. 11 illustrates dispensing mechanism 115 suitable for use in the disclosed dispensing system. Dispensing mechanism 115 comprises button 215 that can activated by a user. Once button 215 is initiated, pumpable product can be dispensed from exit port 120. Particularly, product flows from pouch 10 through pouch fitment 65 and piercing fitment 80, along tubing 110 to be dispensed through dispensing mechanism 115 from exit port 120.

Beyond the simplest embodiments of the dispensing device above described, many more capabilities are possible. For example, the dispensing mechanism can comprise a means of establishing metered flow, means of establishing dose volume, provisions for an electronic output firing signal, use of digital counters, and the like. In some embodiments, the dispensing device can be remote such as those used in carbonated beverage mixing and dispensing systems. Such capabilities are well understood to those of ordinary skill in the art.

Thus, a dispensing device suitable for use with the presently disclosed subject matter can encompass various manual or mechanical actuated valves or pumping systems. Examples of very simple manual valves can include, for example, "clothes-pin" style valves. When the viscosity of packaged product is such that the product cannot be dispensed by gravity forces only and/or when an accurate flow control of the product to be dispensed is desired, a dispensing mechanism assembly can be used. For example, a volumetric positive displacement pump assembly, as is well known in the art, can be used with the disclosed dispensing system.

VI. Pumpable Product

The presently disclosed dispensing system can be used with a wide variety of pumpable products, including (but not limited to) food items, beverage items, and personal care items. Food products suitable for use with the presently disclosed subject matter can include edible products, such as butters, catsup, cheese spreads, chutneys, coffee and other food or beverage extracts, cream, dairy products, dips, essential oils, flavorings, foods, frostings, fruit spreads, glazes, honey, horseradish, jams, jellies, marinades, mayonnaise, mustard, nutritional supplements, oils, preserves, pudding, relish, salad dressings, salsa, sauces (such as hot and pepper sauces, teriyaki sauce, dessert sauces, pesto sauces, pasta sauces, soy sauce, barbeque sauces, sweet and sour sauces, hot, or grilling sauces), seasoning blends, syrups, vinegars, vinaigrettes, or any other types of pumpable food items.

Beverages suitable for use with the presently disclosed dispensing system can include, but are not limited to, carbonated beverages including soft drinks, coffee drinks, energy drinks, fruit and vegetable juices, hot chocolate, milk and other dairy beverages, sports beverages, tea, water, wine and other alcoholic beverages, and any other type of pumpable natural and/or artificial flavored beverages.

The presently disclosed dispensing system can also be used with a wide variety of personal care products, including but not limited to, body oils, body washes, bubble bath, cleaning products (including oils, floor cleaners, carpet cleaners, furniture cleaners, appliance cleaners, disinfectants, gels, glass cleaners, detergents, liniments, pastes, polishes, stain removers, allergen removers, sanitizing systems), colorants, conditioners, creams, deodorants, fabric conditioners, fabric softeners, hairdressings, hair treatments, hand soaps, insect repellants, laundry products, lotions, lubricants, medications, mineral solutions, moisturizers, mouthwashes, ointments, petroleum jellies, pharmaceuticals, salves, shampoos, shaving creams, soaps, sunscreens, and any other type of pumpable personal care items.

Thus, the presently disclosed subject matter can be used for dispensing pumpable products including low viscosity fluids (e.g., juice and non-carbonated beverages), high viscosity fluids (e.g., condiments and sauces), and the like. Non-food products such as fertilizers, motor oil and engine additives, wet cosmetics, medicaments, and the like can also be beneficially packaged and dispensed in the presently disclosed system. One of ordinary skill in the art can appreciate that the above list is not exhaustive, and the presently disclosed system and methods can be used in packaging applications not listed hereinabove.

IV. Methods of Using the Disclosed System

In use, pouch 10 can be inserted in a number of different ways (provided that the flow of pumpable product is not impeded) into carton 5 so long as pouch fitment 65 is positioned into first cut out 50. First cut out 50 is configured to allow pouch fitment 65 to be properly positioned and supported by carton 5. Thus, users require no prior teaching as to the proper position of the pouch within carton 5. Pouch 10 is filled with pumpable product before the pouch is inserted into carton 5. Once pouch 10 has been properly inserted into carton 5, the carton is then sealed on all edges to enclose pouch 10. Particularly, in some embodiments, to complete closing of the carton, an end tab and the opposite end tab are then folded down in such a manner that the pouch fitment fits neatly into first cut out 50, as described in more detail above.

Figure 12A:
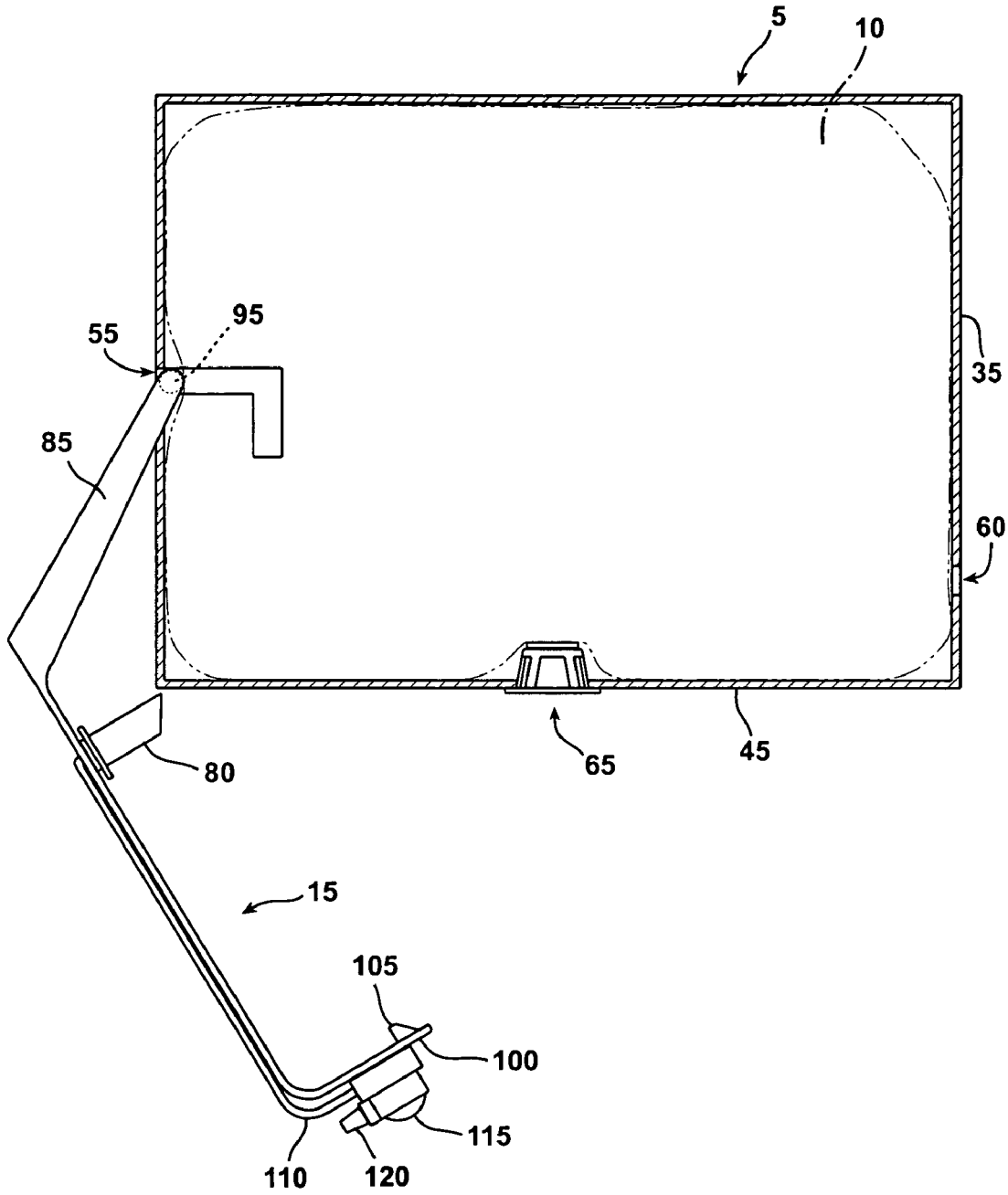
FIGS. 12*a* through 12*d* are side elevation views of the disclosed dispensing systems.
Figure 12B:
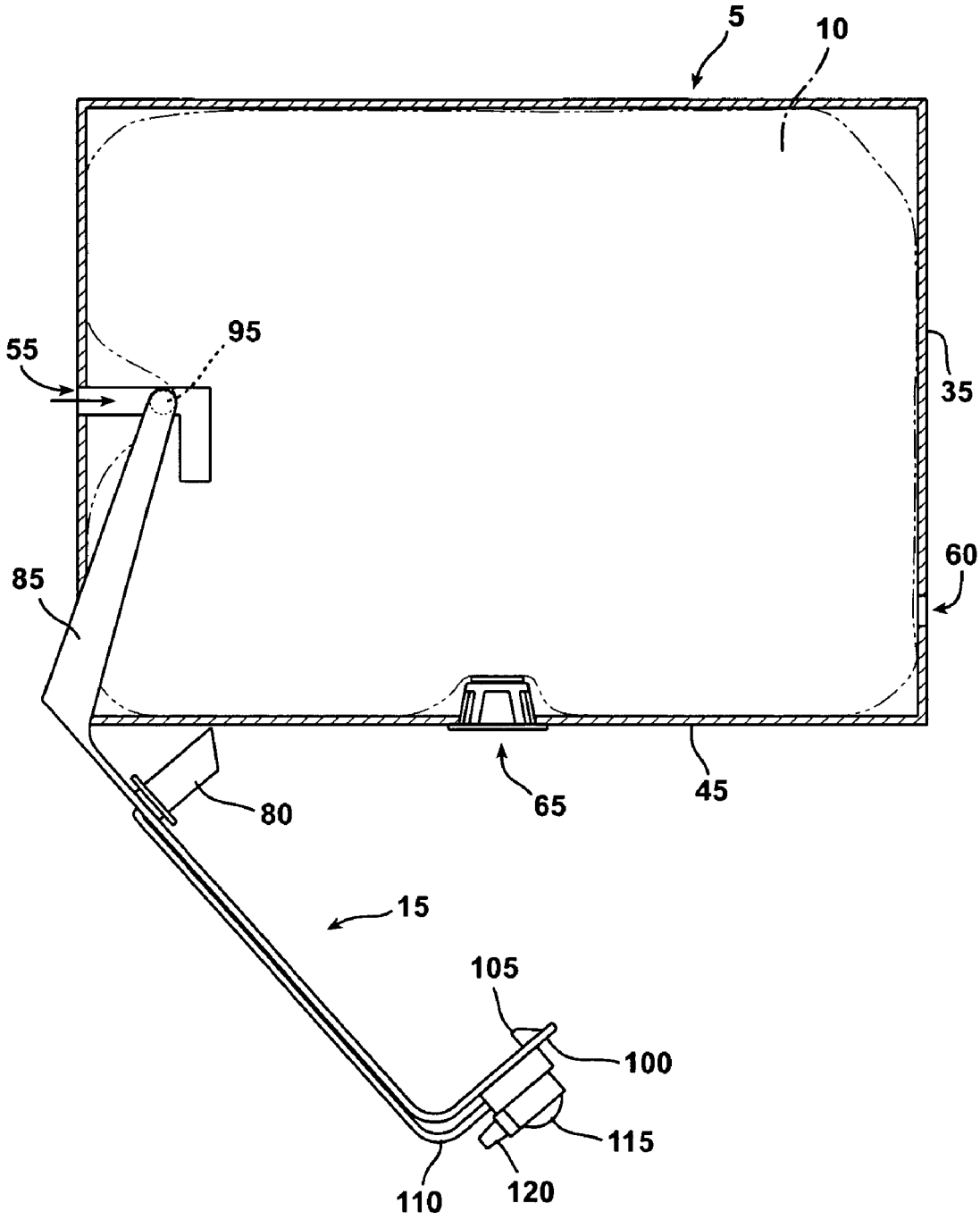
Figure 12C:
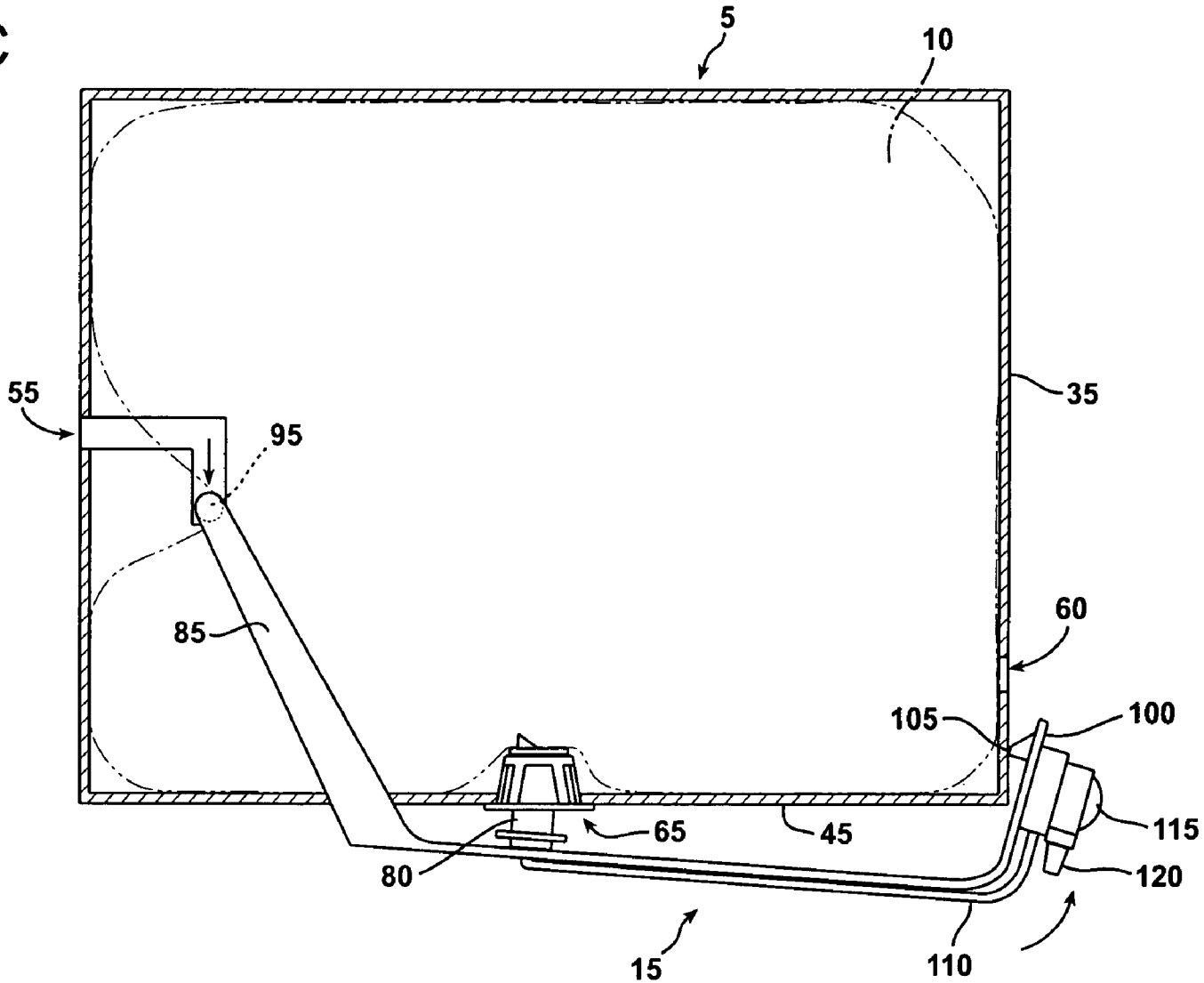
Figure 12D:
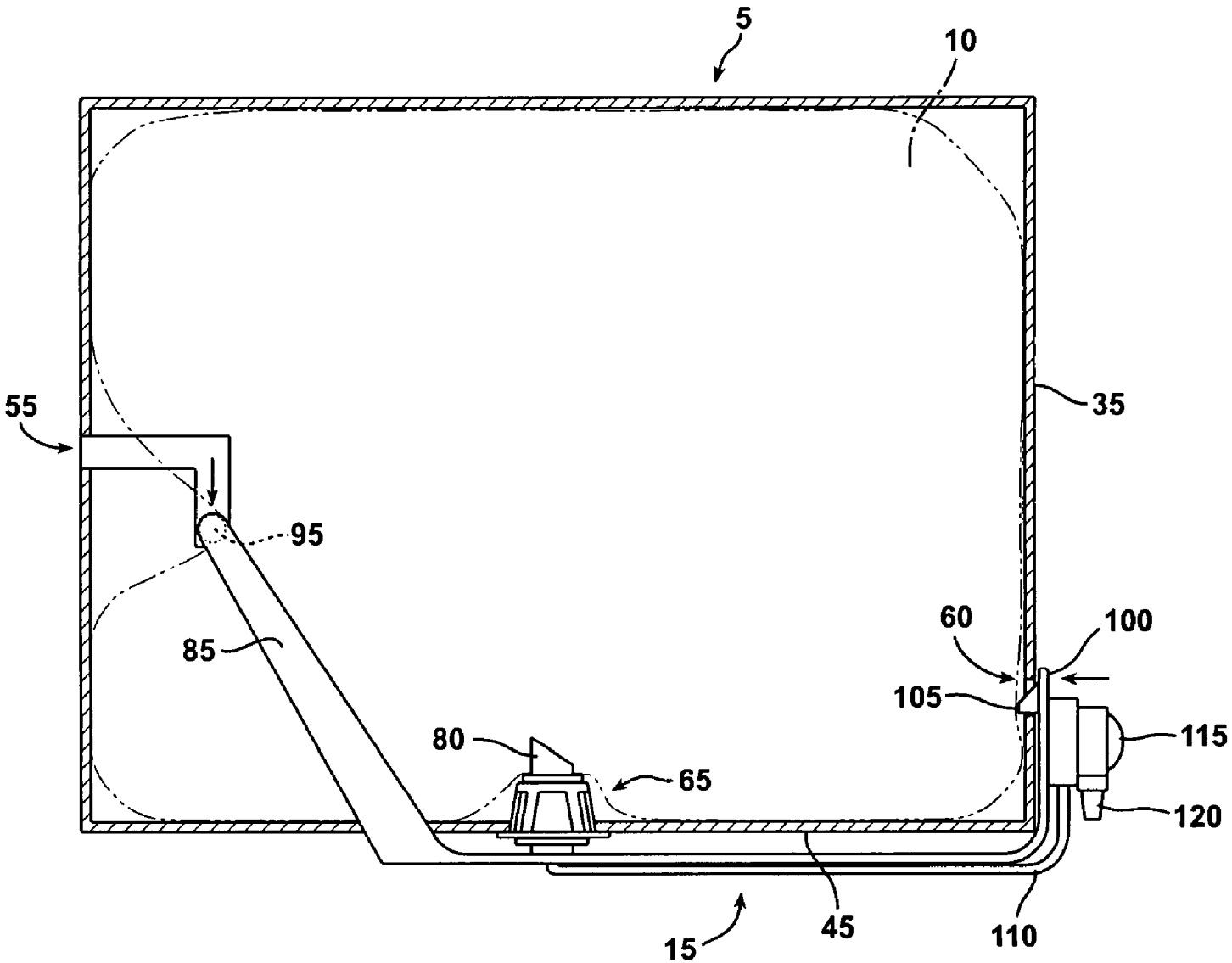

In application, as depicted in the embodiment shown in FIG. 12*a*, connector 95 can slide in a horizontal fashion (relative to carton 5 in the upright position) parallel to bottom face 45 and toward front face 35 into second cut out 55. Connector 95 can then be positioned downward into the vertical portion of second cut out 55 in the upright position (i.e., parallel to front face 35 and toward bottom face 45) as illustrated in FIG. 12*b*. Pump assembly 15 can then be rotated such that piercing fitment 80 aligns with pouch fitment 65, as depicted in FIG. 12*c*. FIG. 12*d* illustrates that support means 105 of support arm 100 can then be maneuvered and inserted into third cut out 60, such that piercing fitment 80 pierces pouch fitment 65.

Figure 13B:
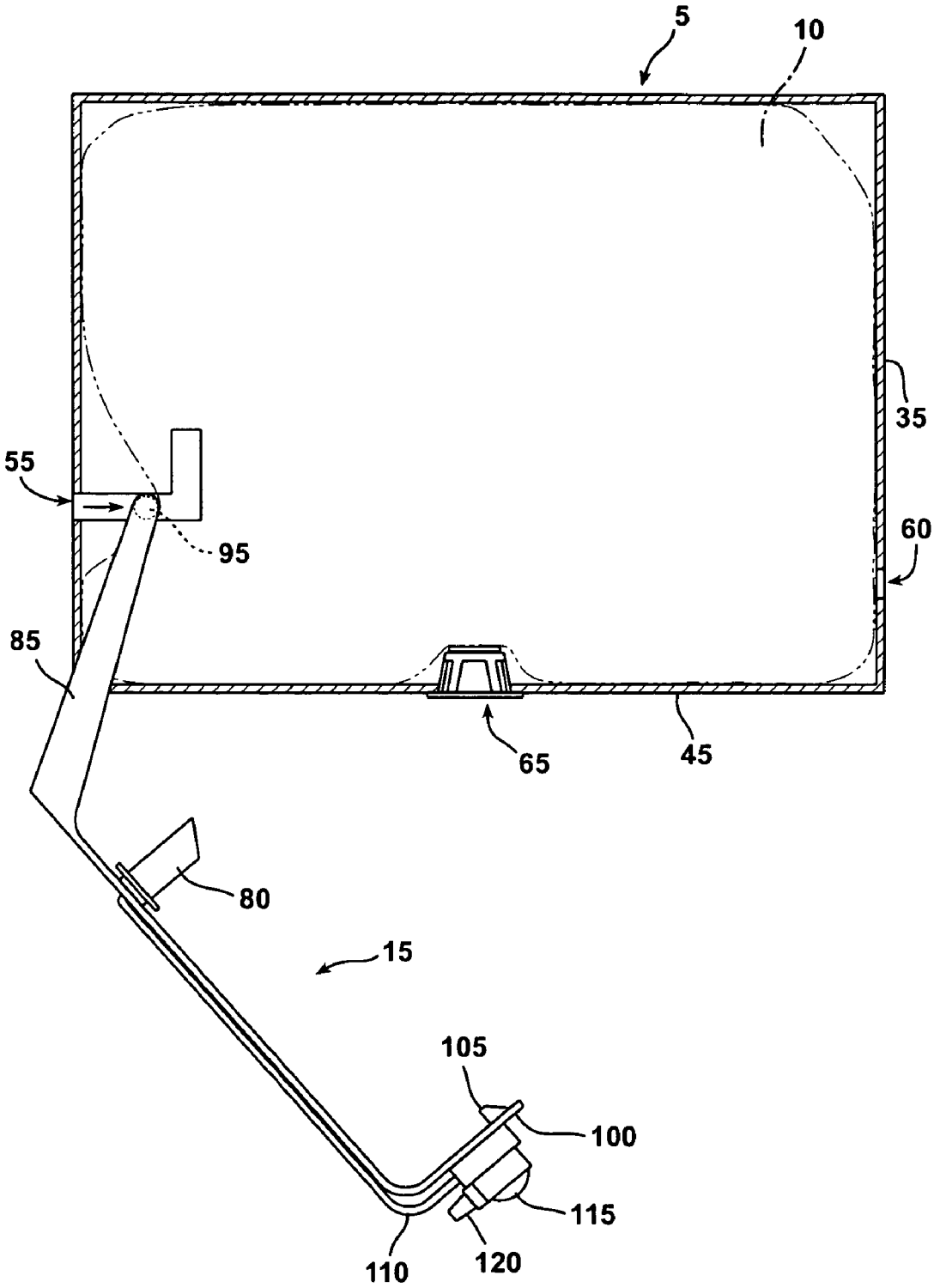
Figure 13C:
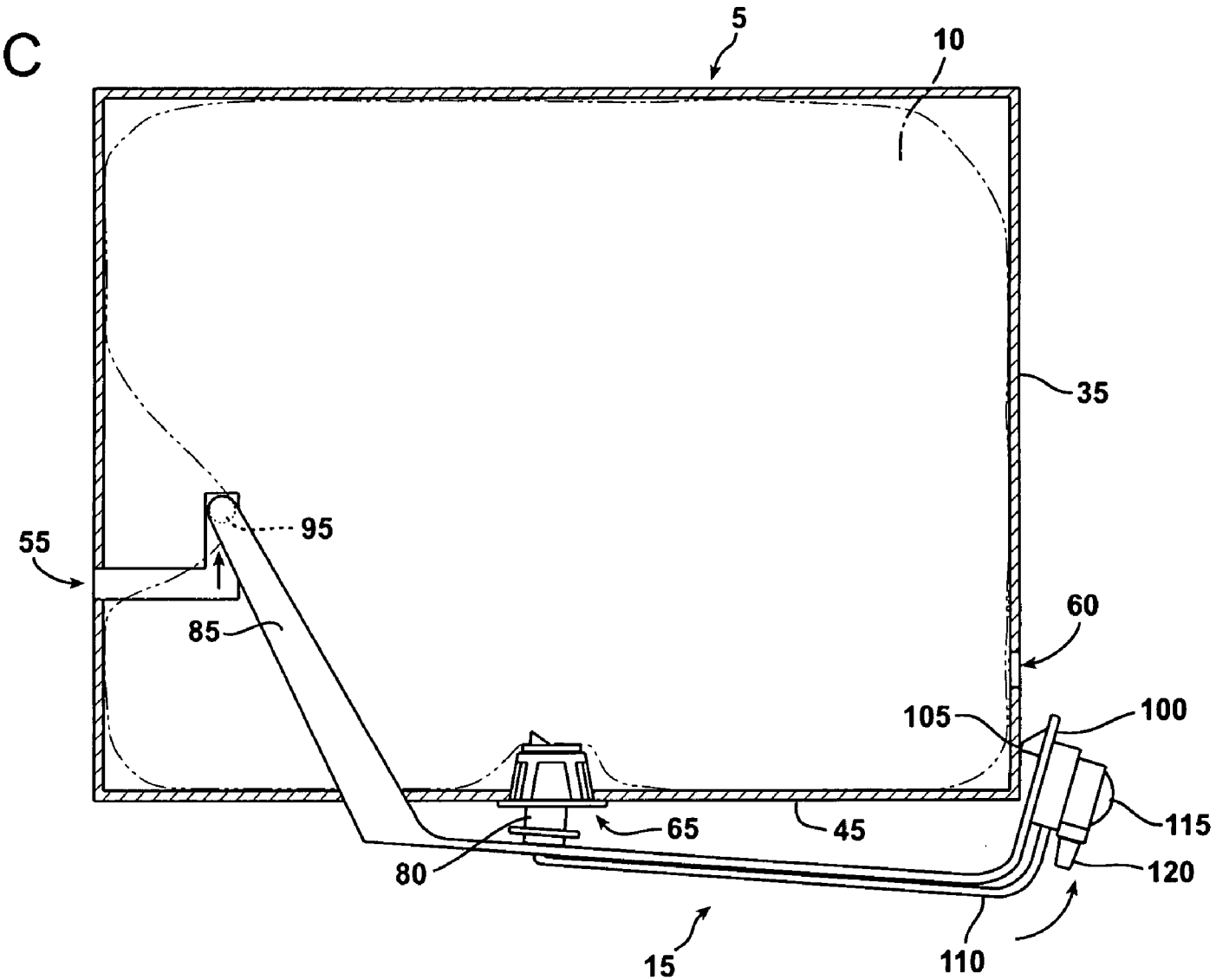
Figure 13D:
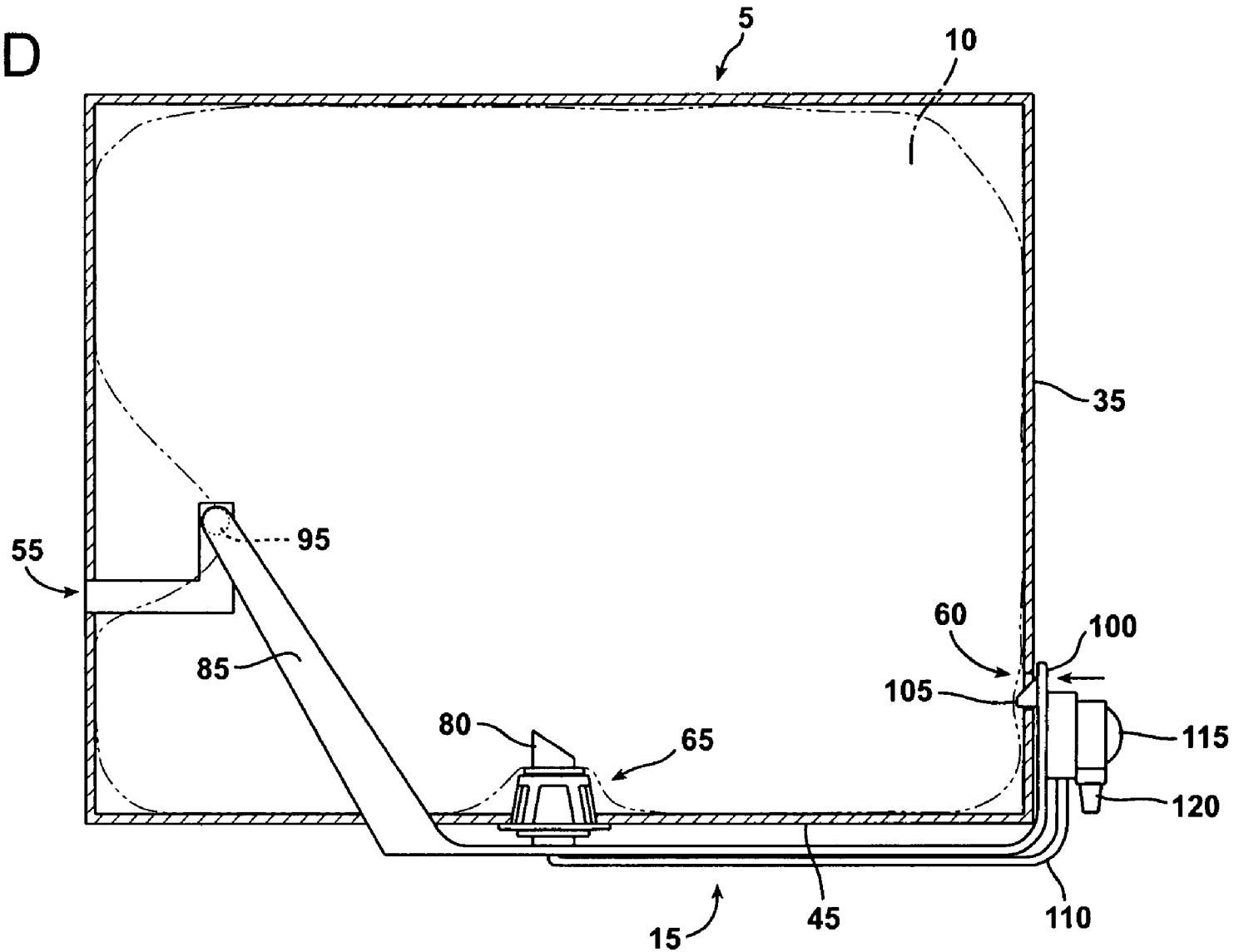

In some embodiments, as depicted in the embodiment shown in FIG. 13*a*, connector 95 can slide in a horizontal fashion (relative to carton 5 in the upright position) parallel to bottom face 45 and towards front face 35 into second cut out 55. Pump assembly 15 can then be rotated such that piercing fitment 80 aligns with pouch fitment 65, as depicted in FIG. 13*b*. FIG. 13*c* illustrates that connector 95 can then be positioned upward into the vertical portion of second cut out 55 in the upright position (i.e., parallel to front face 35 and toward top face 40) such that piercing fitment 80 pierces pouch fitment 65. Support means 105 of support arm 100 can then insert into third cut out 60, as illustrated in FIG. 13*d*.

When it is desired to dispense the pumpable product from pouch 10, users can initiate dispensing mechanism 115 of pump assembly 15. Particularly, once dispensing mechanism 115 is initiated, pumpable product flows from pouch 10, through pouch fitment 65 and pump fitment 80, through tubing 110 to exit the system through exit port 120 on dispensing mechanism 115. Once the contents of pouch 10 have been dispensed, the end user can remove pump assembly 15 and dispose of pouch 10 and/or carton 5.

V. Advantages of the Disclosed System

The presently disclosed dispensing system can be used to economically package and dispense a wide range of pumpable materials. Pouch 10 provides an easy indicator to the end user (based on their pre-learned methods of removing caps or seals from actual cans, bottles, and/or tubes) as to how the contents of the pouch can be accessed. In some embodiments, graphics on pouch 10, carton 5, and/or pump assembly 15 can also help the user to correctly apply the pumpable material onto a desired object by providing a visual indicator as to the precise location of the exit orifice of the dispenser. Further, the pouches, cartons, and pumps can be manufactured economically, thereby allowing producers to offer product to end users with a significant price reduction compared to those pouches and systems that have been available in the past.

Currently, flexible pouches are only rarely used for home dispensing of products, such as fabric softeners, cooking oils, and the like. These pouches typically have a pump or spout that is time-consuming to use and most often is located at the bottom of the package and must be placed at the edge of the counter to dispense the product. The presently disclosed dispensing system allows accurate dispensing of the product at a height convenient to the end user. In addition, the dispensing opening may not have to be located over the edge of a counter. The system offers great deal of flexibility in food and non-food systems as compared to conventional dispensing systems.

Further, in large-scale dispensing environments (such as, for example, the restaurant business), the containers for conventional VPP pouches are typically large, requiring a great deal of space on the work surface. Space is limited in food preparation areas, requiring the use of other, more compact dispensing systems. The presently disclosed dispensing system is comparably small, requiring an estimated 50% or less of the typical prior art dispensing system.

Current pump systems also are costly and often require an additional stand or container. The pouch and fitment must be manually engaged on a table or other hard surface, frequently resulting in leaks when performed by inexperienced users. The system must then be lifted and placed in a separate container for use. No additional external or internal support will be needed to engage the dispenser and package fitments of the presently disclosed dispensing system.

In addition, the disclosed dispensing system comprises a carton that can function to hold and store the pouches in an organized manner. Particularly, carton 5 houses the pouches in an effective and space-friendly manner. Thus, the disclosed system comprises a cartons and/or pumps that can be neatly stacked during storage or while in use. The system allows the end user to make the best use of limited storage space by allowing for the stacking of the dispensers. In comparison, most liquid or pumpable end user products that are dispensed over time are contained in bottles. The bottles are heavy (adding to freight costs during distribution), not stackable, and have limited label area for graphics.

The fitments and pump assembly of the presently disclosed subject matter can advantageously seal the pumpable product in the pouch throughout the shelf life and multiple dispensing of the product. As a result, non-acid products, such as milk-based products, do not require refrigeration during shelf life or usage of the product. However, for certain products it can be desirable to refrigerate the product to provide a better taste, to provide the product at a desired or customary temperature, and/or for any of numerous reasons that are currently known or that later become known.

A further advantage of the presently disclosed system is that no manual refilling of the pumpable product is necessary. When a pouch is empty, the pump can be removed from the carton and the carton and pouch discarded. In some embodiments, the carton can also be discarded. A new carton containing a pouch filled with a pumpable product and fitment can then be installed. The pouch fitment is precisely held in position by the first cut out in the carton such that the dispensing fitment and the pouch fitment are easily and precisely aligned. In some embodiments wherein the pump is preinstalled in the system, the disclosed system requires no handling of the pouch by the end user to make connections and/or to place in a secondary dispenser. Accordingly, the end user merely aligns and/or pierces the pouch fitment with the pump fitment to dispense the contents of the pouch. Alternatively, the system can be purchased pre-equipped with a pump such that the end user merely activates the pump to dispense the pouch contents.

In addition, in the disclosed dispensing system, carton 5 is used as the shipping container of pouch 10 and is also used as the dispenser housing/container. Current systems require that the pouches be removed from the shipping carton, manually pierced with the dispenser fitment, and then placed into the dispenser/container. In the disclosed system, the engagement is accomplished by simply snapping a compact pump system (i.e., pump assembly 15) onto the carton at each side. Thus, engagement of the pump and dispensing fitments are accomplished at the same time and no separate step is required.

The pouch is automatically positioned for complete evacuation of product. Currently, the pouch is manually placed in the dispenser container so that product flows toward the fitment exit. In some embodiments, positioning the fitment for complete product evacuation with the presently disclosed subject matter can be accomplished by locating the fitment/exit from the package at the bottom on the package and gluing the external walls of the pouch to the carton. There are no restrictions on the flow of product toward the exit fitment. In addition, the gluing of the pouch to the walls of the carton will ensure that the pouch film will not collapse over the fitment exit to facilitate and ensure complete evacuation of product. However, it is not required that the pouch walls be adhered to the carton in every embodiment.

The labor-intensive cleaning of the product well of prior art dispensing systems is substantially eliminated because the pouch material shields the internal surface of the base and lid from direct content with the pumpable product. Further, optimal product freshness is promoted by maintaining the product in an enclosed pouch throughout its useful life.

The presently disclosed dispensing system also addresses potential food safety challenges. Particularly, the pumpable product is secured within a pouch and carton to reduce the likelihood of contamination or tampering and/or to indicate that contamination or tampering has occurred. From a cursory visual inspection of the carton of the disclosed system, users are able to determine whether the pouch is leaking and/or whether the carton has been damaged, resulting in potential contamination of the pumpable product. In addition, unlike current dispensing systems, there are no separate components that require regular cleaning to prevent contamination. Rather, once the pumpable product has been dispensed from a pouch, a new carton housing a pouch and pumpable product can be configured with the pump. Thus, the disclosed dispensing system allows pumpable product to be delivered as near as possible to the consumer without introduction of microbial agents, thereby generally increasing the safety of dispensed products.

What is claimed is:

1. A dispensing system for dispensing a pumpable product from a pouch comprising:

a. a carton comprising:
  i. a first cut out to accommodate a pouch fitment;
  ii. a second cut out comprising a horizontal and vertical portion; and
  iii. a third cut out;

b. a pouch disposed within said carton, said pouch comprising:
  i. a first wall and a second wall, a first end and a second end, a first side edge and a second side edge, a first transverse seal and a second transverse seal, and a longitudinal seal disposed between the first side edge and the second side edge, and extending from the first transverse seal to the second transverse seal; and
  ii. a pouch fitment disposed on the first wall of the pouch, wherein the pouch fitment is disposed within the first cut out of said carton; and;

c. a pump assembly comprising:
  i. a piercing fitment that aligns with said pouch fitment;
  ii. two connecting arms joined together by a connector that is inserted into said second cut out of said carton;
  iii. a support arm comprising a support that fits into said third cut out of said carton; and
  iv. a dispensing mechanism;

wherein said pouch is filled with a pumpable product.

2. The dispensing system of claim 1, wherein said pouch is formed by a vertical form-fill-seal technique or a horizontal form-fill-seal technique.

3. The dispensing system of claim 1, wherein the pouch fitment is disposed on the outer surface of the first wall of the pouch, about halfway between the first and second transverse seals of the pouch.

4. The dispensing system of claim 1, wherein said dispensing mechanism is selected from the group consisting of: a spigot, siphon, pump, tap, nozzle, hose, or combinations thereof.

5. A method of dispensing a pumpable product from a pouch, said method comprising:

a. providing a carton comprising:
  i. a first cut out to accommodate a pouch fitment;
  ii. a second cut out comprising a horizontal and a vertical portion; and
  iii. a third cut out;

b. providing a pouch comprising:
  i. a first wall and a second wall, a first end and a second end, a first side edge and a second side edge, a first transverse seal and a second transverse seal, and a longitudinal seal disposed between the first side edge and the second side edge, and extending from the first transverse seal to the second transverse seal; and
  ii. a pouch fitment disposed on the first wall of the pouch, wherein the pouch fitment is disposed within the first cut out of said carton;

c. providing a pump assembly comprising:
  i. a piercing fitment that aligns with said pouch fitment;
  ii. first and second connecting arms joined together by a connector that is inserted into said second cut out of said carton;
  iii. a third arm comprising a support that fits into said third cut out of said carton; and
  iv. a dispensing mechanism;

d. filling said pouch with a pumpable product;

e. positioning said pouch inside said carton such that said pouch fitment is supported by said first cut out;

f. positioning said connector of said pump assembly into said horizontal portion of said second cut out;

g. positioning said connector of said pump assembly into said vertical portion of said second cut out h. positioning said pump assembly such that the pouch fitment is aligned with said piercing fitment;

i. piercing said pouch with said piercing fitment by positioning said piercing fitment within said pouch fitment;

j. inserting said support of said supporting arm into said third cut out of said carton; and k. initiating said pump assembly to dispense pumpable product out of said pouch.

6. The method of claim 5, wherein said pouch is formed by a vertical form-fill-seal technique or a horizontal form-fill-seal technique.

7. The method of claim 5, wherein the pouch fitment is disposed on the outer surface of the first wall of the pouch, about halfway between the first and second transverse seals of the pouch.

8. The method of claim 5, wherein said dispensing mechanism is selected from the group consisting of: a spigot, siphon, pump, tap, nozzle, hose, or combinations thereof.

9. A method of making a dispensing system, said method comprising:

a. providing a carton comprising:

i. a first cut out to accommodate a pouch fitment;

ii. a second cut out comprising a horizontal and a vertical portion; and iii. a third cut out;

b. providing a pouch comprising:

i. a first wall and a second wall, a first end and a second end, a first side edge and a second side edge, a first transverse seal and a second transverse seal, and a longitudinal seal disposed between the first side edge and the second side edge, and extending from the first transverse seal to the second transverse seal; and ii. a pouch fitment disposed on the first wall of the pouch, wherein the pouch fitment is disposed within the first cut out of said carton;

c. providing a pump assembly comprising:

i. a piercing fitment that aligns with said pouch fitment;

ii. two connecting arms joined together by a connector that is inserted into said second cut out of said carton;

iii. a support arm comprising a support that fits into said third cut out of said carton; and iv. a dispensing mechanism;

d. filling said pouch with a pumpable product;

e. positioning said pouch inside said carton such that said pouch fitment is supported by said first cut out;

f. positioning said connector of said pump assembly into said horizontal portion of said second cut out;

g. positioning said connector of said pump assembly into said vertical portion of said second cut out;

h. positioning said pump assembly such that the pouch fitment is aligned with said piercing fitment;

i. piercing said pouch with said piercing fitment by positioning said piercing fitment within said pouch fitment;

j. inserting said support of said supporting arm into said third cut out of said carton; and k. initiating said pump assembly to dispense pumpable product out of said pouch.

10. The method of claim 9, wherein said pouch is formed by a vertical form-fill-seal technique or a horizontal form-fill-seal technique.

11. The method of claim 9, wherein the pouch fitment is disposed on the outer surface of the first wall of the pouch, about halfway between the first and second transverse seals of the pouch.

12. The method of claim 9, wherein said dispensing mechanism is selected from the group consisting of: a spigot, siphon, pump, tap, nozzle, hose, or combinations thereof.

* * * * *